US009972932B2

(12) United States Patent
Copper et al.

(10) Patent No.: US 9,972,932 B2
(45) Date of Patent: May 15, 2018

(54) ELECTRICAL CONNECTOR WITH HIGH RETENTION FORCE

(71) Applicants: FCI AMERICAS TECHNOLOGY LLC, Carson City, NV (US); FCI ASIA PTE. LTD., Singapore (SG)

(72) Inventors: Charles Copper, Hummelstown, PA (US); Gert Droesbeke, Chartres (FR); Aymeric Soudy, Besancon (FR)

(73) Assignees: FCI Americas Technology LLC, Carson City, NV (US); FCI Asia Pte, Ltd., Singapore (SG)

( * ) Notice: Subject to any disclaimer, the term of this patent is extended or adjusted under 35 U.S.C. 154(b) by 0 days. days.

(21) Appl. No.: 14/459,603

(22) Filed: Aug. 14, 2014

(65) Prior Publication Data

US 2015/0050838 A1 Feb. 19, 2015

Related U.S. Application Data

(60) Provisional application No. 61/867,587, filed on Aug. 19, 2013, provisional application No. 61/921,988, filed on Dec. 30, 2013.

(51) Int. Cl.
*H01R 24/00* (2011.01)
*H01R 13/11* (2006.01)
(Continued)

(52) U.S. Cl.
CPC ..... *H01R 13/114* (2013.01); *H01R 13/113* (2013.01); *H01R 4/185* (2013.01);
(Continued)

(58) Field of Classification Search
CPC .. H01R 13/114; H01R 4/185; H01R 13/4223; H01R 2201/26
(Continued)

(56) References Cited

U.S. PATENT DOCUMENTS 3,781,770 A 12/1973 Manicini
3,836,947 A * 9/1974 Yeager ..... H01R 13/113 439/839
(Continued)

FOREIGN PATENT DOCUMENTS

DE 10 2004 052 378 A1 5/2006
DE 102006062704 A1 2/2008
(Continued)

OTHER PUBLICATIONS

International Search Report and Written Opinion dated Feb. 3, 2014 for Application No. PCT/IB2013/001340.
(Continued)

*Primary Examiner* — Tulsidas C Patel
*Assistant Examiner* — Peter G Leigh
(74) *Attorney, Agent, or Firm* — Wolf, Greenfield & Sacks, P.C.

(57) ABSTRACT

An electrical terminal includes an electrically conductive monolithic body including a mating end having a base, a contact beam spaced from the base in an upward direction, a side wall that extends from the base to the contact beam, and a spring assist member. The contact beam can be elastically flexible from an initial position whereby the spring assist member is spaced from the contact beam in the upward direction, to a deflected position whereby the contact beam abuts the spring assist member. The electrical is suited for assembly into a connector assembly which includes and inner core and an outer housing.

22 Claims, 19 Drawing Sheets

(51) Int. Cl.
*H01R 4/18* (2006.01)
*H01R 13/422* (2006.01)

(52) U.S. Cl.
CPC ..... *H01R 4/188* (2013.01); *H01R 13/4223* (2013.01); *H01R 2201/26* (2013.01)

(58) Field of Classification Search
USPC ..... 439/626, 851, 852, 850, 856, 857, 842, 439/843
See application file for complete search history.

(56) References Cited

U.S. PATENT DOCUMENTS 4,720,272 A 1/1988 Durand
4,722,704 A 2/1988 Van Der Stuyf et al.
4,898,548 A 2/1990 Case et al.
4,900,271 A 2/1990 Colleran et al.
4,950,183 A 8/1990 Watanabe
5,252,097 A 10/1993 Lindeberg et al.
5,259,796 A 11/1993 Yamada et al.
5,281,175 A * 1/1994 Chupak ..... H01R 13/113 439/839
5,382,177 A 1/1995 Hutchinson, Jr. et al.
5,593,328 A * 1/1997 Okada ..... H01R 13/11 439/843
5,651,700 A 7/1997 Sato et al.
5,681,190 A 10/1997 Childs
5,690,517 A * 11/1997 Betsui ..... H01R 13/113 439/839
5,735,717 A * 4/1998 Nabeshima ..... H01R 13/113 439/851
5,762,524 A 6/1998 Ford et al.
5,865,636 A 2/1999 Myer et al.
5,938,485 A * 8/1999 Hotea ..... H01R 13/18 439/839
5,951,339 A 9/1999 Chaillot et al.
6,039,615 A * 3/2000 Suzuki ..... H01R 13/113 439/849
6,193,551 B1 2/2001 Yamamoto et al.
6,305,992 B1 * 10/2001 Bouda ..... H01R 13/113 439/834
6,379,199 B1 * 4/2002 Chen ..... H01R 13/11 439/451
6,475,040 B1 * 11/2002 Myer ..... H01R 13/11 439/374
6,524,135 B1 2/2003 Feldman et al.
6,547,608 B2 * 4/2003 Sato ..... H01R 13/11 439/851
6,669,507 B2 * 12/2003 Yamanashi ..... H01R 13/4223 439/595
7,048,582 B2 * 5/2006 Tabata ..... H01R 13/113 439/595
7,156,704 B2 * 1/2007 Shimizu ..... H01R 13/113 439/852
7,252,564 B1 * 8/2007 Morello ..... H01R 4/185 439/843
7,278,883 B2 * 10/2007 Tyler ..... H01R 13/4364 439/595
7,294,027 B1 11/2007 Tyler
7,303,027 B1 12/2007 Laemmer
7,351,122 B2 * 4/2008 Suemitsu ..... H01R 13/113 439/852
7,938,695 B2 * 5/2011 Furutani ..... H01R 4/185 439/852
7,950,972 B1 * 5/2011 Chen ..... H01R 13/111 439/852
7,976,351 B2 * 7/2011 Boemmel ..... H01R 13/432 439/748
8,043,130 B2 * 10/2011 Casses ..... H01R 43/16 439/850
8,241,076 B2 * 8/2012 Kubota ..... H01R 13/113 439/852
8,241,077 B2 * 8/2012 Suzuki ..... H01R 13/114 439/839
8,747,156 B2 * 6/2014 Hirabayashi ..... H01R 13/113 439/595
9,039,467 B2 * 5/2015 Seipel ..... H01R 4/185 439/877
9,054,431 B2 * 6/2015 Endo ..... H01R 4/185
9,136,641 B2 9/2015 Bishop
9,166,325 B2 10/2015 Bishop
9,466,893 B2 10/2016 Bishop
2002/0076999 A1 * 6/2002 Chen ..... H01R 13/187 439/851
2002/0160666 A1 10/2002 Sato et al.
2005/0153605 A1 * 7/2005 Anbo ..... H01R 13/113 439/852
2005/0227551 A1 * 10/2005 Tabata ..... H01R 13/113 439/852
2005/0287877 A1 * 12/2005 Fukuda ..... H01R 13/187 439/850
2006/0073741 A1 * 4/2006 Bommersheim ..... H01R 13/18 439/850
2006/0094305 A1 * 5/2006 Masaki ..... H01R 13/113 439/850
2008/0070452 A1 * 3/2008 Komiyama ..... H01R 13/113 439/852
2010/0197177 A1 * 8/2010 Myer ..... H01R 13/187 439/852
2010/0197178 A1 * 8/2010 Hotea ..... H01R 13/187 439/852
2011/0212656 A1 * 9/2011 Suzuki ..... H01R 13/114 439/852
2012/0034827 A1 * 2/2012 Ishikawa ..... H01R 13/113 439/850
2012/0264340 A1 10/2012 Mueller
2012/0295493 A1 11/2012 Hirabayashi
2013/0102180 A1 * 4/2013 Muro ..... H01R 13/114 439/345
2013/0143454 A1 * 6/2013 Onuma ..... H01R 4/188 439/877
2013/0288547 A1 * 10/2013 Amano ..... H01R 13/11 439/852
2015/0303593 A1 * 10/2015 Ono ..... H01R 12/728 439/850
2016/0104948 A1 4/2016 Droesbeke et al.

FOREIGN PATENT DOCUMENTS

JP H1140233 2/1999
JP 2000-067975 A 3/2000
JP 2001/135398 5/2001
JP 3390331 B2 3/2003
JP 2009/283308 12/2009
WO WO 2010/015894 2/2010
WO WO 2011/067632 A1 6/2011
WO WO 2013/046663 4/2013

OTHER PUBLICATIONS

International Preliminary Report on Patentability dated Dec. 17, 2015 for Application No. PCT/IB2013/001340.
International Search Report and Written Opinion dated Nov. 21, 2014 for Application No. PCT/US2014/051203.
International Preliminary Report on Patentability dated Mar. 3, 2016 for Application No. PCT/US2014/051203.
Extended European Search Report for European Application No. 14838530.5 dated Feb. 21, 2017.

* cited by examiner

ELECTRICAL CONNECTOR WITH HIGH RETENTION FORCE

CROSS-REFERENCE TO RELATED APPLICATIONS

This application claims benefit of U.S. Provisional Patent Application Ser. No. 61/867,587 filed Aug. 19, 2013 and to U.S. Provisional Patent Application Ser. No. 61/921,988 filed Dec. 30, 2013, the disclosures of both of which are hereby incorporated by reference as if set forth in their entireties herein.

BACKGROUND

Electrical connectors often include a dielectric electrically insulative connector housing and a plurality of electrical terminals supported by the connector housing. Certain known electrical terminals include a mounting end that is configured to be crimped onto an electrically conductive cable so as to place the cable in electrical communication with the terminal, and a mating end that is configured as a receptacle that receives a plug that, in turn, is electrically connected to another complementary electrical device.

SUMMARY

In accordance with one embodiment, an electrical terminal includes an electrically conductive monolithic body having a receptacle mating end. The receptacle mating end includes a base, a contact beam spaced from the base, a side wall that extends from the base to the contact beam, and a spring assist member. The arrangement results in a receptacle mating end which is elastically flexible from an initial position to a deflected position and is biased by the spring assist member either before, during or after deflection.

The present disclosure also relates to a connector, such as an optical or electrical connector, e.g., a cable connector configured to be coupled with a pin header connector, more particularly cable connectors for use in automotive applications, e.g., for cooperation with an on-board pin header connector on a printed circuit board or a similar substrate.

The connector includes a core and a housing with a receiving cavity configured to receive the core, the connector comprising at least one stop pushed outwardly during insertion of the core into the receiving cavity and snapping back when the core is in its final position.

As a result, the stop snaps back into its original retracted position only if the core is fully and correctly inserted and snapped into the housing of the connector. If the core is not correctly snapped into the housing, the stops will remain to be pushed outwardly and hinders insertion of the connector into a matching counterconnector.

In a specific exemplary embodiment the stops are part of respective snap-action levers, each lever having a recess for cooperation with a cam to provide a snap connection. When passing the stop, the cam pushes the stop outwardly during insertion of the core into the receiving cavity. These recesses and cams can be configured such that incorrect insertion of the core into the receiving cavity would prevent snapping of at least one of the cams into the respective recess. The cams can for example be wedge-shaped, slanting down in an assembling direction, and can be part of the core, while the snap-action levers are part of the housing, or the other way around. In a more particular embodiment, the snap-action levers extend in a direction opposite to an assembling direction, the levers having central openings receiving the wedge-shaped cams, the stop being part of a terminal end of the respective lever. To balance forces during assembly, the wedge-shaped cams of the core can be at two opposite sides of the core.

Optionally, the core may include at least one channel for providing access to a beveled contact face of a respective one of the snap-action levers of the housing. This makes it possible to lift the snap-action lever to a release position allowing disassembly of the connector.

Optionally, the connector may include one or more pin receiving terminal contacts and a housing, wherein the housing comprises for each terminal contact a pin receiving opening aligned with the terminal contact and a test opening providing access to a side surface of the terminal contact. This allows easy testing, e.g., with a spring-loaded test-pin, to check if the terminal contact is in its correct position. It can also be used for other tests, such as testing the crimp connection or a hipot test.

In a further possible embodiment, the connector may include a plurality of latching cams providing a non-releasable snap connection with engaging sections of a mating pin header connector. A larger number of latching cam secures the connection between the two connectors by enhancing the retention force required for disrupting the connection, and by providing redundant latching. The connector may for example comprise at least one upward directed latch cam and at least two oppositely positioned sideward directed latching cams.

The latching cams may for example jointly provide a retention force which is less than a retention force provided by a snap connection between the housing and the core. This can for example be realized if, after connecting the cable connector with a matching pin header connector, the part of the snap-action levers carrying the stops are locked by the casing of the pin header connector when the core is in its final position in the casing. Such locking of the levers substantially increases the force required to pull the core apart from the housing. This prevents that the cable connector is pulled apart during an attempt to disconnect the two connectors by force, thereby exposing potentially powered contacts.

The cams can for example be are part of a latch. Such a latch may for example have one end connected by a hinge connection to a contacting side of the housing and a free end pointing towards a cable entry side of the housing.

The connector can be designed to be plugged partly into a receiving cavity of a complementary connector with the free end of the latch partly protruding from said receiving cavity. The core may comprise one or more extensions at least partly covering the protruding part of the latch to protect the latch, e.g., from unintentional flexing. The extensions may also pre-load the latch by slightly flexing it down. Such extensions of the core can for example include two upward extending side arms with inwardly bent top edges extending over the latch.

To prevent incorrect insertion of the core into the housing, the receiving cavity in the housing can for example be polarized to allow insertion of the core in only one single position.

In an exemplary embodiment the core may include clips clipping ends of connected cables, the housing comprising recesses locking and tightening the clips after insertion of the core into the housing.

If so desired a set of similar connectors can be used each connector being provided with a different number of contacts, each connector comprising a contact side exposing the contacts for cooperation with a counter connector, the contact side being having a coded profile allowing connection only with a counter connector with the same number of contacts. The coded profile may for instance include one or more extensions, wherein the width of individual extensions decreases with the number of contacts. This way, it is prevented that connectors with a smaller amount of contacts are erroneously connected to receiving connectors with a larger number of contacts.

The invention also relates to an assembly of a connector as disclosed above with a counterconnector comprising a counter stop blocking the stop of the connector when the stop is pushed outwardly.

The disclosed connectors are particularly useful for use in the automotive field, e.g., for connecting LED lamps to a PCB controlling and/or powering the LED lamps.

BRIEF DESCRIPTION OF THE DRAWINGS

The foregoing summary, as well as the following detailed description of example embodiments of the application, will be better understood when read in conjunction with the appended drawings, in which there is shown in the drawings example embodiments for the purposes of illustration. It should be understood, however, that the application is not limited to the precise arrangements and instrumentalities shown. In the drawings.

DETAILED DESCRIPTION

Figure 1A:
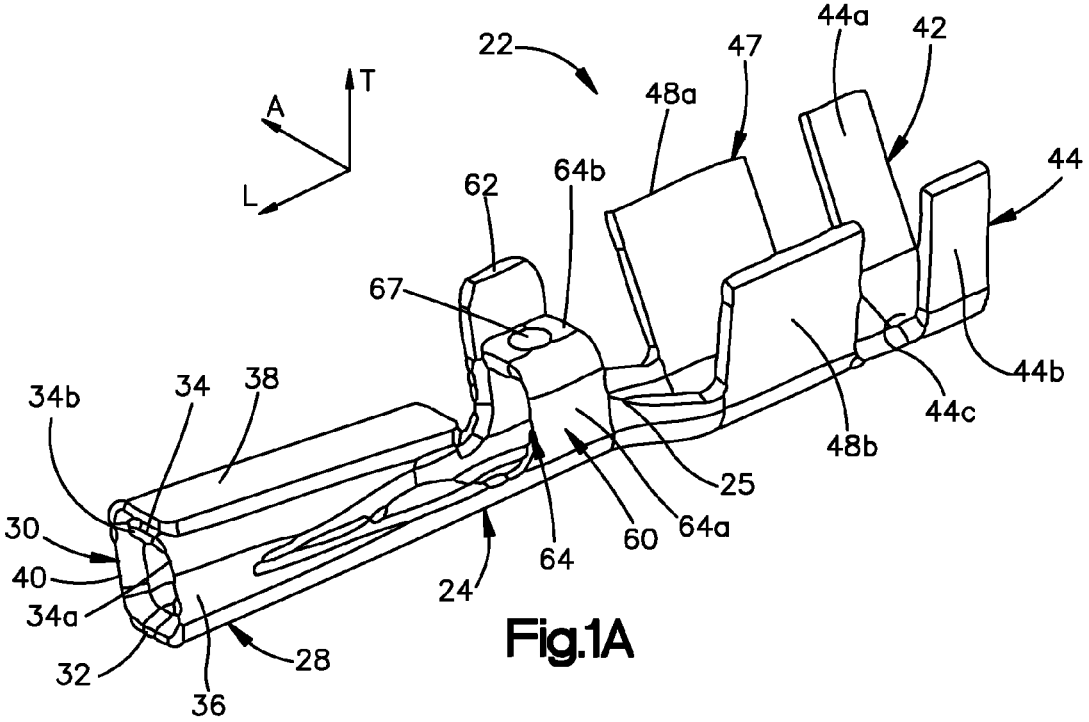
FIG. 1A is a perspective view of an electrical terminal constructed in accordance with one embodiment.

Referring initially to FIGS. 1A-2B, an electrical terminal 22 includes an electrically conductive monolithic body 24, such that all components of the electrical terminal 22 can be monolithic with each other. It should be appreciated, however, unless otherwise indicated, that various components of the electrical terminal 22 can be separate from one or more other components of the electrical terminal 22 as desired. In accordance with the illustrated embodiment, the electrical terminal is constructed by forming a stamped sheet of material 26, such as sheet metal, which can be stainless steel, tin, copper, alloys including the same, or any alternative suitable electrically conductive material. The stamped sheet of material 26 can be bent so as to define the electrical terminal 22 as described herein. In one example, a plurality of stamped sheets of material 26 can be supported by a common carrier strip 27, and can be formed into respective electrical terminals 22. Thus, the electrical terminals 22 and the carrier strip 27 can be monolithic with each other. The electrical terminals 22 can be separated from the electrical terminal 22 in the usual manner.

Referring now to FIGS. 1A-1D in particular, the body 24 defines a mating end 28 that can define a receptacle 30. For instance, the mating end 28 can include a base 32 and a contact beam 34 that is spaced from the base 32 in an upward direction. The upward direction extends along a transverse direction T that also includes a downward direction opposite the upward direction. Base 32 extends for a distance along the longitudinal direction L. The receptacle 30 can further include a first side wall 36 that extends at one end from the base 32 to the contact beam 34, for instance along the transverse direction T, and which defines an opening at the other end. The receptacle 30 can further include a second side wall 40 that extends at one end from the base 32 to a spring assist member 38, for instance along the transverse direction T, and which defines an opening at the other end. Contact beam 34 and spring assist 38 each extend a distance along direction L. The first and second side walls 36 and 40 can be spaced from each other along a lateral direction A that is perpendicular to the transverse direction T. The base 32, contact beam 34, first side wall 36, and second side wall 40 can be combined to define a receptacle 30 that is configured to receive a complementary electrical plug terminal 35. For instance, the receptacle 30 can receive the complementary electrical plug terminal 35 (see FIG. 3) in a mating direction. The mating direction can be oriented along a longitudinal direction L that is perpendicular to the transverse direction T and the lateral direction A.

Figure 1B:
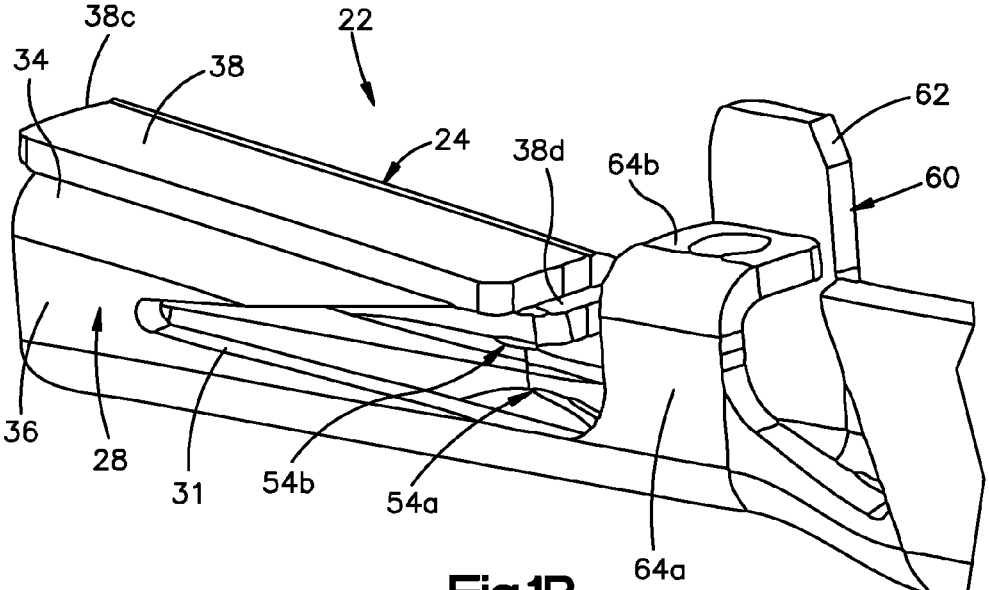
FIG. 1B is an enlarged perspective view of a mating portion of the electrical terminal illustrated in FIG. 1A.

The contact beam 34 is elastically flexible from an initial position to a deflected position rotated away from base 32. In order to achieve the desired deflection of contact beam 34 and spring assist 38, side walls 36 and 40 each define slot-like, triangular shaped openings 31 and 33 which extend along a portion of the length of contact beam 34 and spring assist 38. Upon insertion of pin 35, contact beam 34 and spring assist 38 will pivot away from base 32 in relation to the size and shape of openings 31 and 33 and the size of pin 35. In this regard, the contact beam 34 can be referred to as a spring member abutting spring assist 38 at one end. The spring assist member 38 is separated from the contact beam 34 at one end 38*c* in the upward direction by a gap in the transverse direction T and abuts contact beam 34 at its other end 38*d* when the contact beam 34 is in the initial position. The gap at end 38*c* can, for instance, have an initial distance between 0.1 mm to 0.5 mm in the transverse direction T. For instance, the gap can be approximately 0.2 mm when the contact beam 34 is in an initial position. The contact beam 34 presses against spring assist 38 as it is deflected from the initial position to a rotated deflected position. Thus, the spring assist member 38 acts as a brace for the contact beam 34 during deflection. As shown in FIGS. 1B and 1D, contact beam 34 and spring assist 38 are angled in the transverse direction T along the direction L at different angles. In such an arrangement, one end 38*c* of the proximal end 38*a* of the spring assist member 38 can be spaced from one end of the proximal end of 34*a* the contact beam 34 in the upward direction while the other end 38*d* of spring assist 38 abuts contact beam 34.

Figure 9:
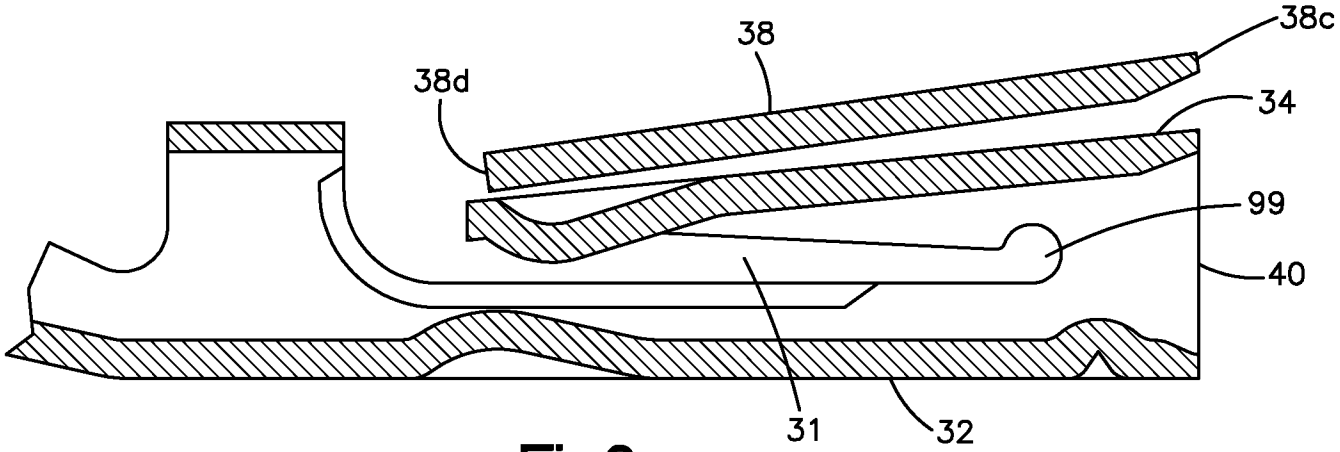
FIG. 9 is an alternate embodiment of the electrical terminal illustrated in FIG. 8.

Alternatively, the spring assist member 38 can be separated from the contact beam 34 along its length in the upward direction, as shown in FIG. 9, by a gap in the transverse direction T when the contact beam 34 is in the initial position. The gap can, for instance, have an initial distance between 0.1 mm to 0.5 mm in the transverse direction T. For instance, the gap can be approximately 0.2 mm when the contact beam 34 is in an initial position. The contact beam 34 is deflectable from the initial position to a deflected position whereby the contact beam 34 abuts the spring assist member 38. For instance, the contact beam 34 defines an abutment location that abuts the spring assist member 38 when in the deflected position, and is spaced from the spring assist member 38 to define the gap when in the initial position. Thus, the spring assist member 38 can be configured to provide a brace for the contact beam 34 after the contact beam 34 has reached a deflected position. Having spring assist 38 spaced from contact member 34 is believed to be particularly advantageous for use with plug pins 35 having an initial length in which the cross section is smaller than the cross section of the remaining pin.

It is noted that the rotation of contact beam 34 away from base 32 may also include the deflection of base 32 by a pin being inserted into receptacle 30.

Figure 3:
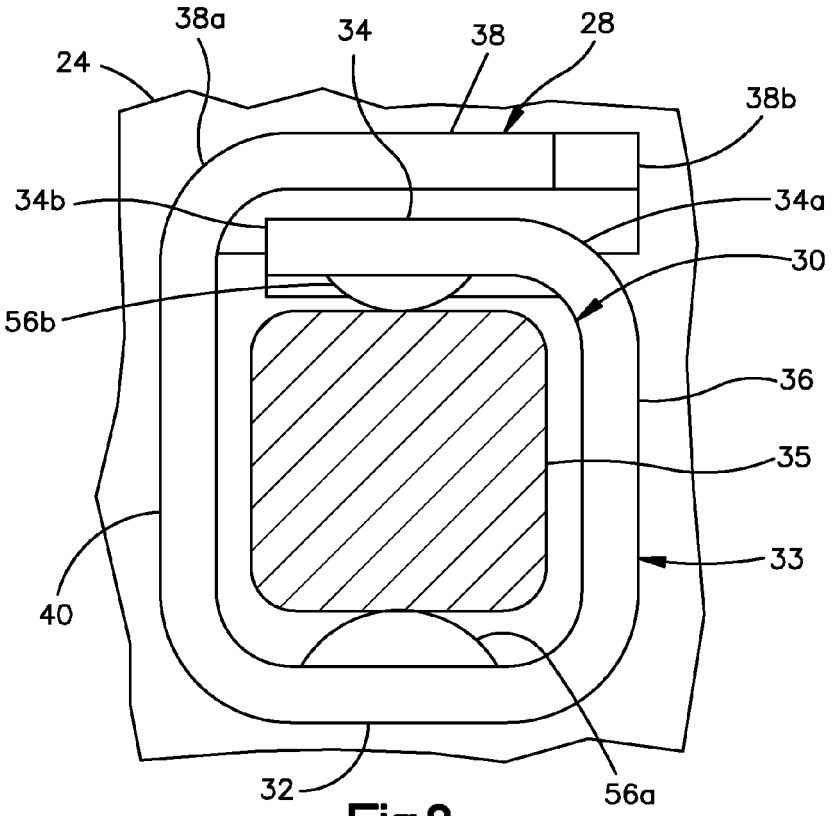
FIG. 3 is an end view of the electrical terminal illustrated in FIG. 1A, having received a complementary electrical plug terminal.
Figure 4:
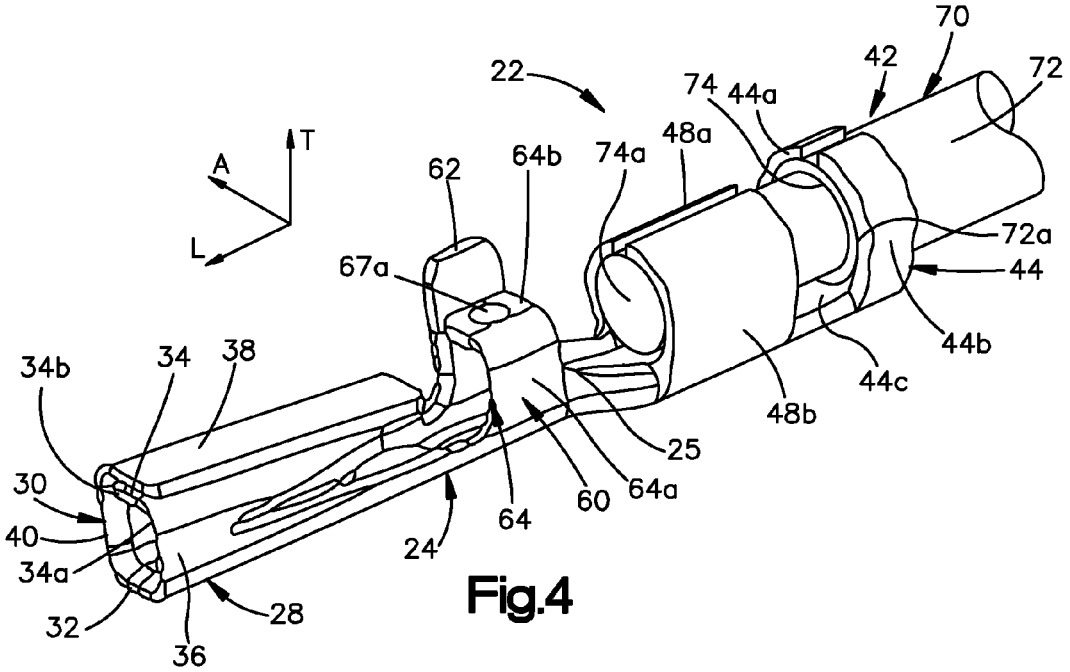
FIG. 4 is a perspective view of the electrical terminal illustrated in FIG. 1A shown mounted to an electrical cable.

Referring now also to FIG. 3, the receptacle 30 is configured to receive the complementary electrical plug terminal 35, such that the plug terminal 35 urges the contact beam 34 and spring assist 38 from the initial position to a rotated, deflected position. The contact beam 34, abutting spring assist 38, together with the shape of openings 31 and 33 are configured, in combination, to provide a minimum normal or contact force of approximately 3-4 Newtons, from the contact beam 34 against the received complementary electrical terminal. The contact force can be in the range of approximately 3 Newtons and 8 Newtons, such as between 4 Newtons and 6 Newtons, for instance approximately 4 Newtons. The complementary electrical plug terminal 35 can be of a complementary electrical connector that can be mounted onto a complementary electrical component, which can be a printed circuit board. Thus, when the electrical terminal 22 receives the complementary electrical plug terminal 35 in the receptacle 30, the electrical terminal 22 is placed in electrical communication with the complementary electrical component. It is noted that in order to achieve the listed retention forces, depending on the material used, a sufficient mass of material will be necessary. The arrangement of having the spring assist overlap the contact beam and the shape of openings 31 and 33 results in the assembled receptacle having the desired mass.

In accordance with one embodiment, the contact beam 34 is cantilevered from the first side wall 36 in a first direction substantially along the lateral direction A. For instance, the contact beam 34 defines a proximal end 34*a* that extends from the side wall 36, and a distal end 34*b* that is a free end. Thus, the distal end 34*b* can be spaced from the proximal end 34*a* in the first direction substantially along the lateral direction A. The distal end 34*b* can further be spaced from the spring assist member 38 when the contact beam is in the initial position. The distal end 34*b* is configured to abut the spring assist member 38 while the contact beam 34 is deflecting. The electrical terminal 22 can define only a single cantilevered arm 33 that is cantilevered from the base 32, such that the single cantilevered arm 33 defines the first side wall 36 and the contact beam 34.

As described above, the mating end 28 can further include the second side wall 40 that extends from the base 32 to the spring assist member 38. In accordance with one embodiment, the spring assist member 38 is cantilevered from the second side wall 40 in a second direction substantially along the lateral direction A. The second direction can be opposite the first direction such that contact beam 34 and spring assist 38 overlap. For instance, the spring assist member 38 defines a proximal end 38*a* that extends from the second side wall 40, and a distal end 38*b* that is a free end. Thus, the distal end 38*b* can be spaced from the proximal end 38*a* in the second direction substantially along the lateral direction A. Thus, the contact beam 34 can be referred to as an upper contact beam, though it should be appreciated that the contact beam 34 can be positioned elsewhere as desired, for instance adjacent the base, or either of the side walls. As depicted in FIGS. 1B and 1D, the first and second side walls 36 and 40 each have a varying respective height from the base 32 along the transverse direction T resulting in the angled orientation of contact beam 34 and spring assist 38. Contact beam 34 and spring assist 38 are angled along the direction L. The height of the second side wall 40 can be greater than the respective height of the first side wall 36. When the contact beam 34 is in the initial position, the distal end 34*b* of the contact beam 34 is spaced from the proximal end 34*a* of the contact beam 34 in the first direction. The distal end 38*b* of the spring assist member 38 is spaced from the proximal end 38*a* of the spring assist member 38 in the second direction that is opposite the first direction, such that contact beam 34 and spring assist 38 overlap. The first and second directions can extend along the lateral direction A, or in a direction that is offset with respect to the lateral direction A. In accordance with an alternate embodiment, the spring assist member 38 can be a spring assist wall that is oriented substantially parallel to the contact beam 34. Although the receptacle portion of terminal 22 is depicted in a box-like form, it should be understood that other forms are acceptable. For example, terminal 22 could be formed to have a generally cylindrical shape.

Figure 1D:
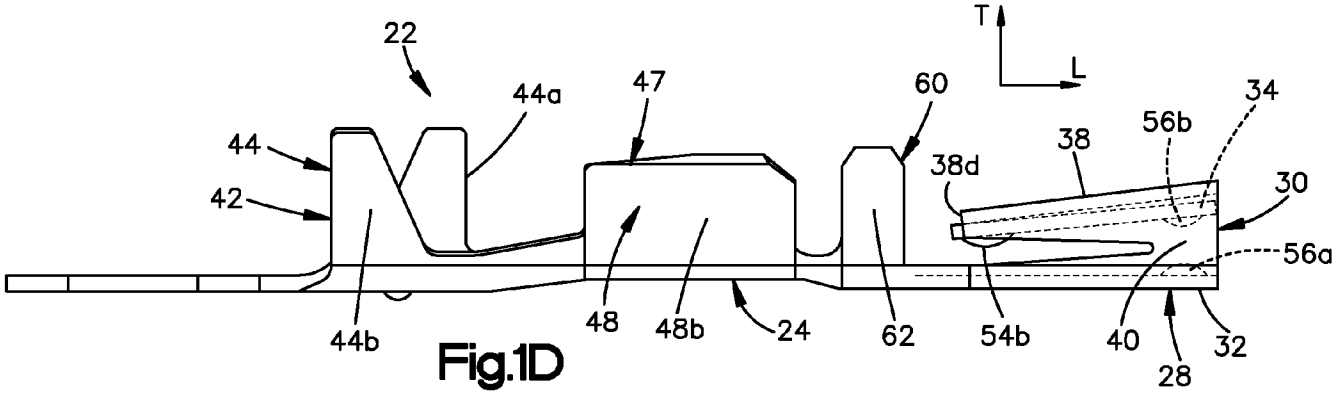
FIG. 1D is a side elevation view of the electrical terminal illustrated in FIG. 1A.
Figure 2A:
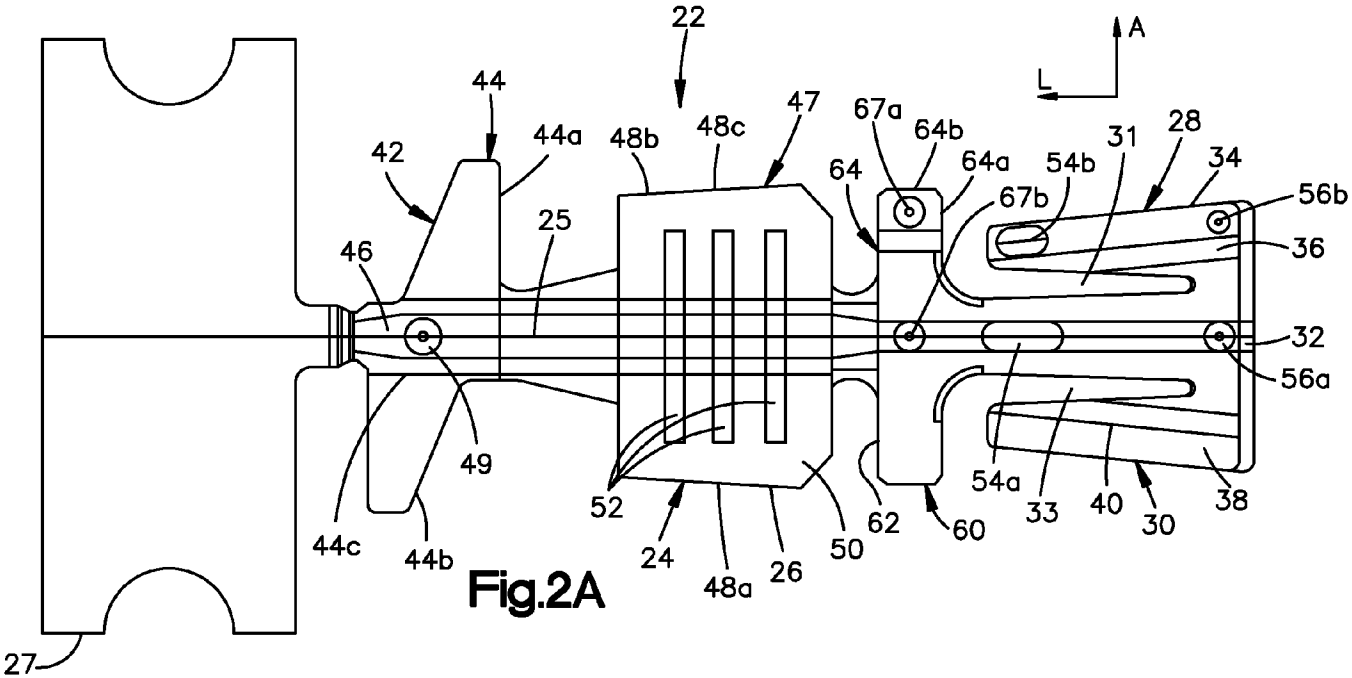
FIG. 2A is a top plan view of a stamped sheet of material used to construct the electrical terminal illustrated in FIG. 1A.
Figure 2B:
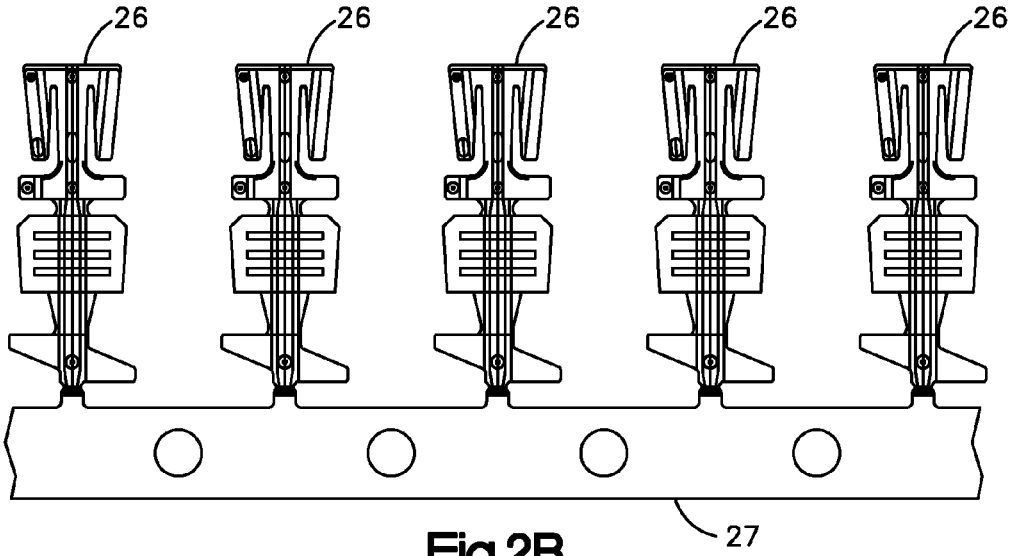
FIG. 2B is a top plan view of a plurality of stamped sheets of material as illustrated in FIG. 2A, supported by a common carrier strip.

Referring also to FIG. 2A, the mating end 28 can include a first contact bump 54*a* that projects from the base 32 into the receptacle 30 toward the contact beam 34. Alternatively or additionally, the mating end 28 can include a second contact bump 54*b* that projects from the contact beam 34 into the receptacle 30 toward the base 32. The first and second contact bumps 54*a* and 54*b* define respective first and second contact locations that contact the complementary electrical plug terminal 35 in a pinching relationship when the plug terminal 35 is received in the receptacle 30. The first and second contact bumps 54*a* and 54*b* can further be elongate in the longitudinal direction L, the lateral direction A, or any other direction as desired, thereby controlling the points of engagement between receptacle 30 and pin 35. The first contact bump 54*a* can be embossed in the base 32. The second contact bump 54*b* can be embossed in the contact beam 34. As depicted particularly in FIGS. 1B, 1D, 6, 7 and 8, it is preferred for spring assist 38 to abut contact member 34 proximate second contact bump 54*b*.

Figure 6:
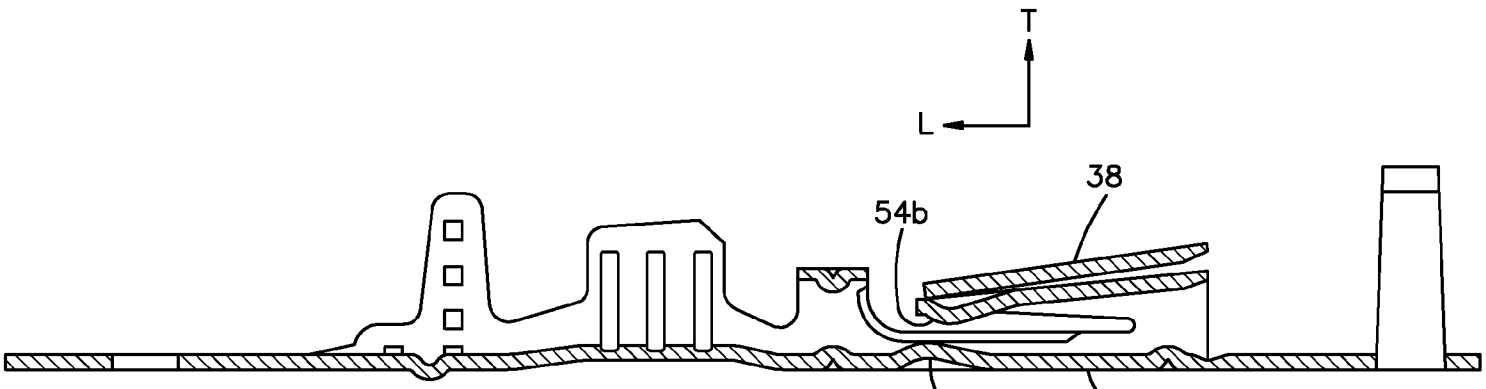
FIG. 6 is a section view of an alternate embodiment of the electrical terminal illustrated in FIG. 1D.
Figure 7:
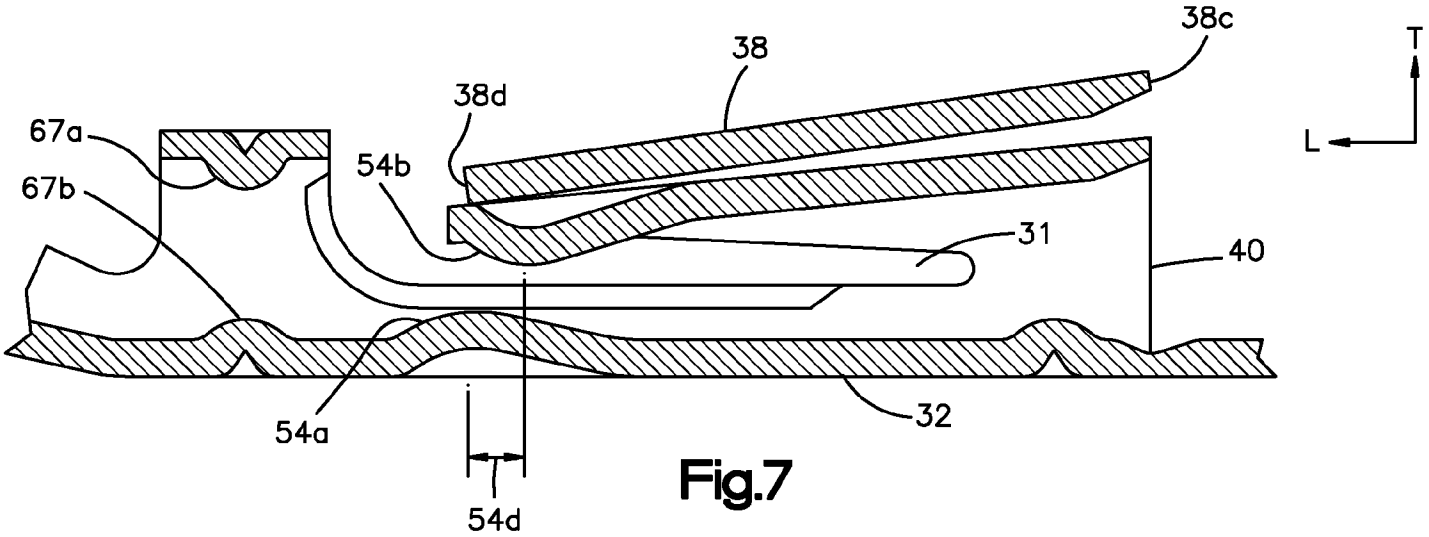
FIG. 7 is an enlarged view of the receptacle portion of the electrical terminal illustrated in FIG. 6.

As also illustrated in FIGS. 6 and 7, the first and second contact bumps 54*a* and 54*b* can define a pair of contact bumps that define respective apices that are offset from each other along the longitudinal direction L. For instance, the apex of the first contact bump 54*a* can be offset any distance 54*d* as desired in the rear direction with respect to the apex of the second contact bump 54*b*. The distance 54*d* can be within the range of approximately 0.1 mm to approximately 0.5 mm. For instance, the distance 54*d* can be 0.3 mm. The offset can allow the electrical terminal to position itself around the complementary electrical plug terminal 35. It should be appreciated that a third contact bump 56*a* will contact the complementary electrical plug terminal 35, as described in more detail below. Alternatively, the first and second contact bumps can be aligned with each other along the transverse direction T.

Figure 1C:
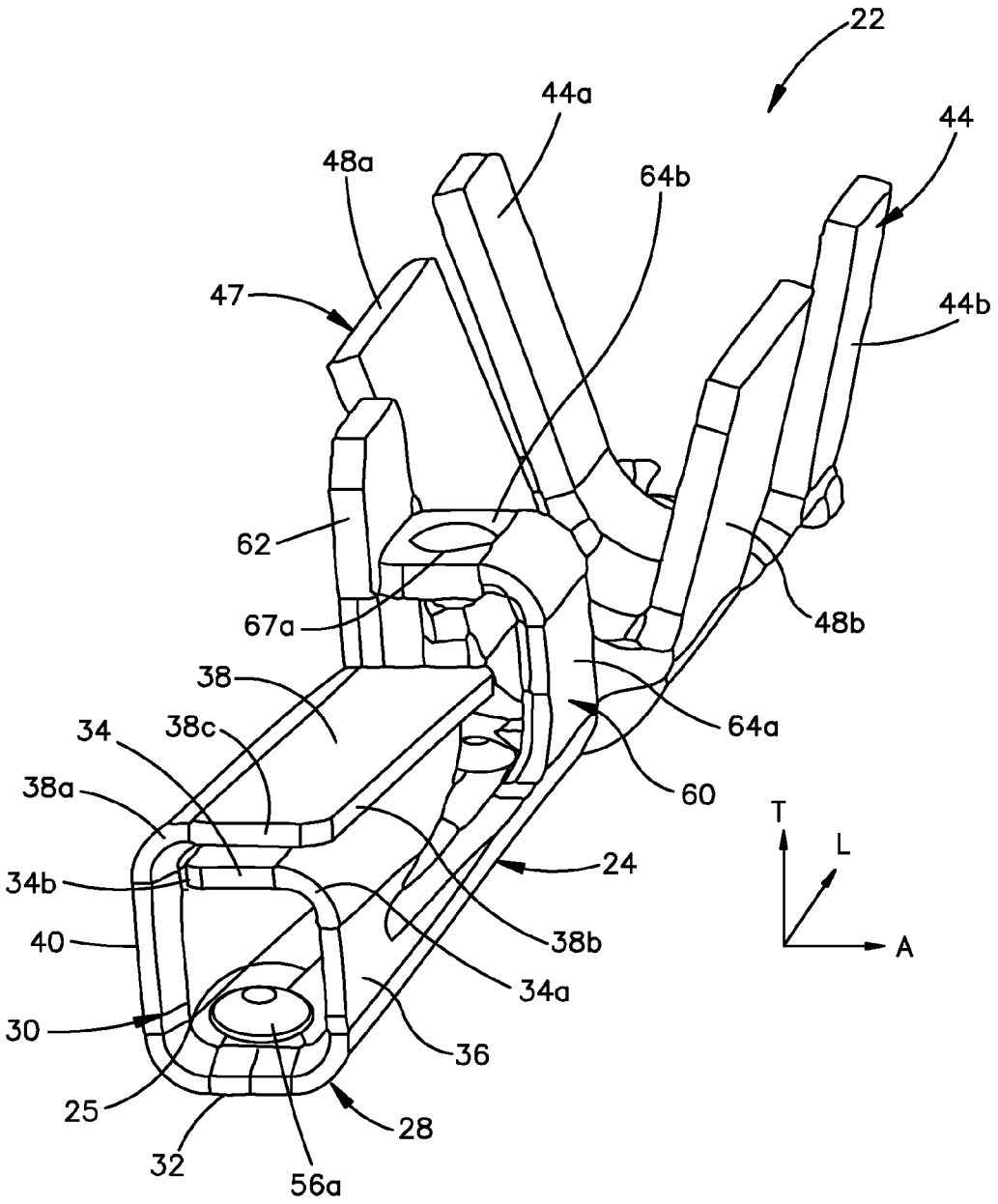
FIG. 1C is another perspective view of the electrical terminal illustrated in FIG. 1A.

Alternatively or additionally, as depicted in FIGS. 1C and 2A, the mating end 28 can define a second pair of contact bumps 56*a* and 56*b*. The second pair of contact bumps can be spaced from the first pair of contact bumps 54*a* and 54*b* in a forward direction. Thus, the mating end 28 can include a third contact bump 56*a* that extends from the base 32 into the receptacle 30 toward the contact beam 34. Alternatively or additionally, the mating end 28 can include a fourth contact bump 56*b* that extends from the contact beam 34 into the receptacle 30 toward the base 32. The third contact bump 56*a* can be embossed in the base 32. The fourth contact bump 56*b* can be embossed in the contact beam 34. Each of the third and fourth contact bumps 56*a* and 56*b* defines a dimension in the longitudinal direction L that is less than that of each of the first and second contact bumps 54*a* and 54*b*. It should be appreciated that the contact bumps 54*a*-54*b* and 56*a*-56*b* can define any suitable size and shape as desired. The contact surfaces defined by the contact bumps 54*a*-54*b* and 56*a*-56*b* are configured to contact the complementary electrical terminal when inserted into the receptacle 30 and serve to control the points of engagement between terminal 22 and pin 35.

Referring again to FIGS. 1A-1D and FIG. 4, the electrical terminal 22 further includes a mounting end 42 is configured to attach to an electrical cable 70 along the longitudinal direction L. The mating end 28 can be spaced from the mounting end 42 in the forward direction. The electrical cable 70 can, for instance, include an outer electrically insulative layer 72 and at least one electrical conductor 74 that extends through the layer 72. The electrical conductor 74 can include a free portion 74*a* that extends out an end 72*a* of the layer 72. The mounting end 42 can be spaced from the mating end 28 along the longitudinal direction L. Furthermore, the mounting end 42 can be aligned with the mating end 28 along the longitudinal direction L. The mounting end 42 can include a first crimp tab 44 that is configured to retain the outer insulative layer 72 of the electrical cable 70 that is received therein. The mounting end 42 can further include a contact member 47 that is configured to be placed in electrical communication with the electrical conductor 74 of the electrical cable 70. For instance, the contact member 47 can be configured as a second crimp tab 48 that is configured to be crimped onto the electrical conductor. The second crimp tab 48 can be disposed between the first crimp 44 tab and the receptacle 30.

The first crimp tab 44 can include a crimp base 44*c* and at least one crimp arm that extends out from the crimp base 44*c*. For instance, the first crimp tab 44 can include a pair of crimp arms 44*a* and 44*b* that extend out from the crimp base 44*c*. The crimp arms 44*a* and 44*b* can be flexible with respect to the crimp base 44*c* so as to be crimped about the outer insulative layer 72 so as to secure the electrical cable 70 to the electrical terminal 22. The first and second crimp arms 44*a* and 44*b* can be offset with respect to each other along the longitudinal direction L, or can be aligned with each other along the lateral direction A as desired. The crimp base 44*c* can be aligned with the base 32 along the longitudinal direction L. It should be appreciated that the body 24 can define a base 25 that defines both the crimp base 44*c* and the base 32. The crimp base 44*c* defines a retention surface 46 such that the crimp arms 44*a* and 44*b* are configured to crimp the outer insulative layer against the retention surface 46. The crimp base 44*c* can include a raised contact bump 49 (see FIG. 2A) that extends out from the retention surface 46 toward the outer insulative layer 72. The contact bump 49 can be an embossment in the first crimp tab 44, for instance in the crimp base 44*c*. Thus, the crimp arms 44*a* and 44*b* are configured to crimp the outer insulative layer against the contact bump 49.

It is preferable, however, for contact bump 49 to extend away from outer insulative layer 72, As explained in greater detail below, the contact bump 49 extends away from the outer insulative layer 72, so that the contact bump 49 can assist in the proper positioning of the electrical terminal 22 within the cavity of the housing 82.

Similarly, the second crimp tab 48 can include a crimp base 48*c*, and at least one crimp arm that extends out from the crimp base 48*c*. For instance, the second crimp tab 48 can include a pair of crimp arms 48*a* and 48*b* that extend out from the crimp base 48*c*. The crimp arms 48*a* and 48*b* can be flexible with respect to the crimp base 48*c* so as to be crimped about the electrical conductor 74, and in particular about the free portion 74*a* of the electrical conductor 74. The crimp base 48*c* can be aligned with the crimp base 44*c* and the base 32 along the longitudinal direction L. Thus, the base 25 of the body 24 can defines the crimp bases 44*c*, the crimp base 48*c* and the base 32 of the mating end 28. The crimp base 48*c* defines a contact surface 50 that is configured to contact the electrical conductor 74 when the crimp arms 48*a* and 48*b* are crimped about the electrical conductor 74. The crimp base 48*c* can define one or more raised contact bumps 52 (see FIG. 2A) that extend out from the contact surface 50 toward the electrical conductor 74 and function to enhance the grip and consequently the retention of conductor 74. The contact bumps 52 can be configured as strips that are elongate along the lateral direction A, and can be embossments in the second crimp tab 48, for instance in the crimp base 48*c*. It should be appreciated that the contact bumps 49 and 52 can define any suitable size and shape as desired.

It may be understood that terminal 22 can have other forms of mounting end 42. Although mounting end 42 is displayed as a cable crimp configuration, mounting end 42 can also include an IDC (insulation displacement) slot, a wire wrap or solder tail attached to base 32, wall 64*b* or one of the other side walls.

Figure 5A:
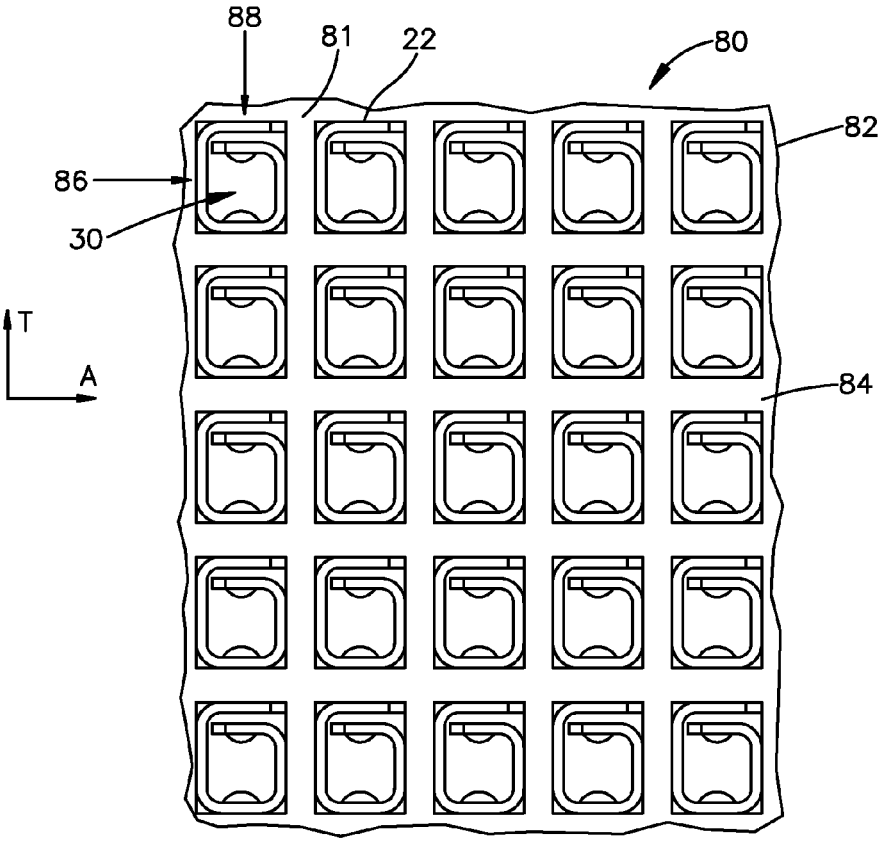
FIG. 5A is a front elevation view of an electrical connector including a connector housing and a plurality of electrical terminals constructed as illustrated in FIG. 1A supported by the connector housing.
Figure 5C:
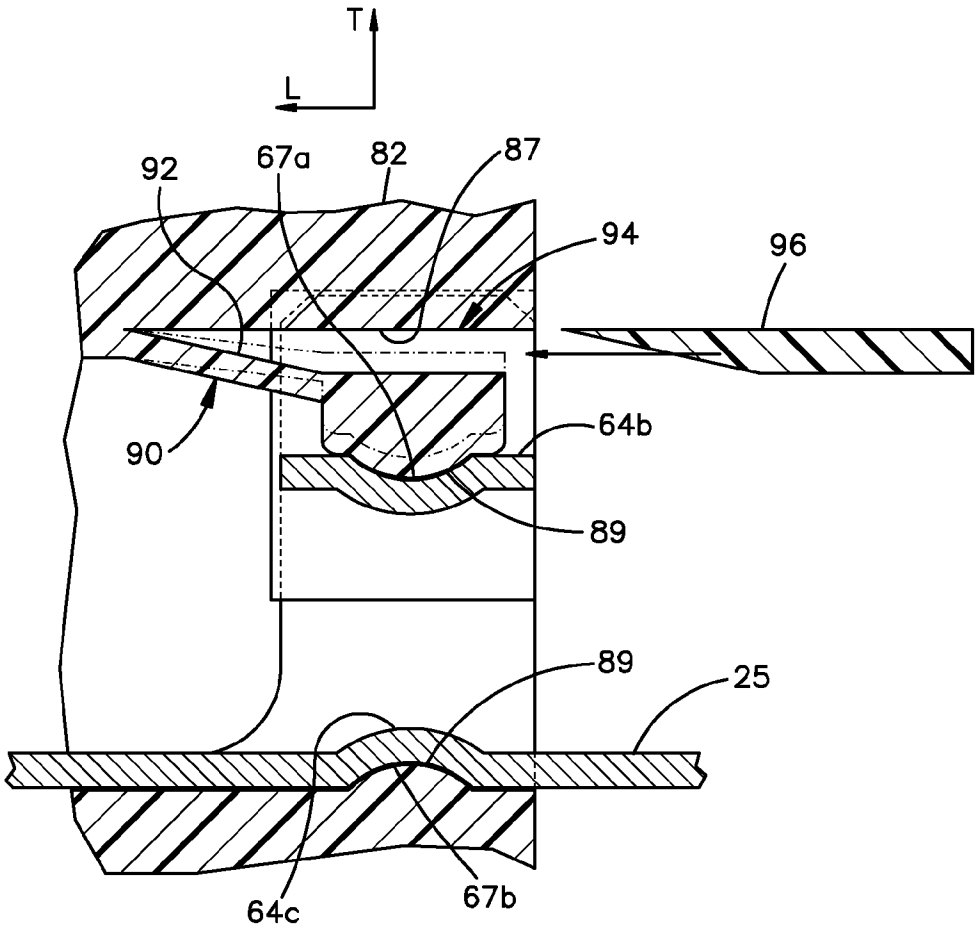
FIG. 5C is a sectional side elevation view of the electrical connector illustrated in FIG. 5B, taken along line 5C-5C.
Figure 5B:
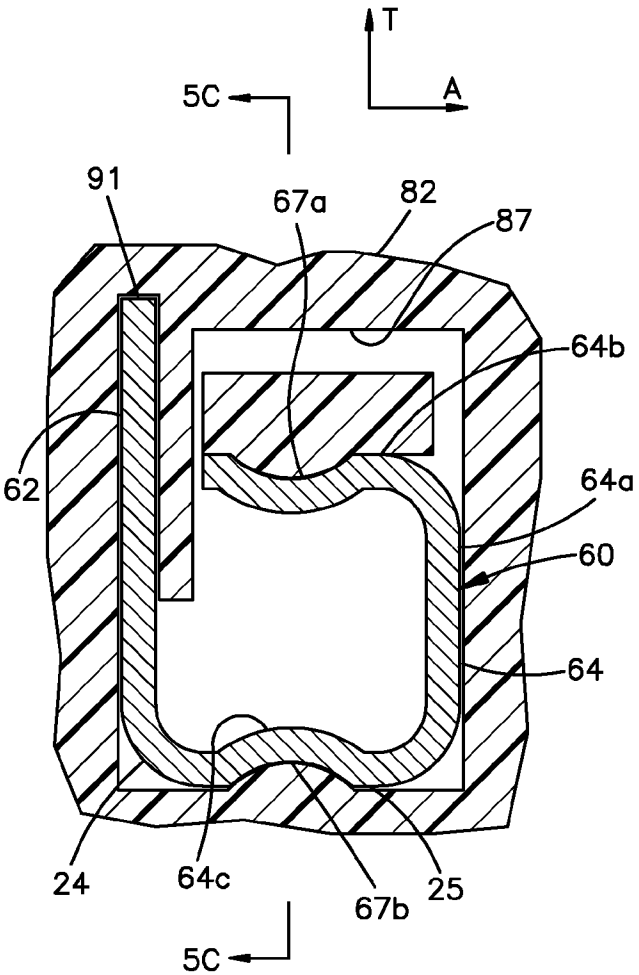
FIG. 5B is a sectional end elevation view of the electrical connector illustrated in FIG. 5A.

Referring now to FIGS. 5A-5C, it should be appreciated that an electrical connector 80 can include a dielectric or electrically insulative connector housing 82 and a plurality of the electrical terminals 22 supported by the connector housing 82. The electrical terminals 22 can be supported by the connector housing 82 so as to be are arranged in an array 84 that includes a plurality of rows 86 that extend along the lateral direction A and columns 88 that extend in the transverse direction T. Adjacent ones of the electrical terminals 22 along the lateral direction A, that is along a respective one of the rows 86, can be spaced a distance from center-to-center along the lateral direction A between approximately 1.2 mm and approximately 1.45 mm, such as between approximately 1.25 mm and approximately 1.45 mm, such as approximately 1.27 mm. Adjacent ones of the electrical terminals 22 along the transverse direction T, that is along a respective one of the columns 88, can be spaced the same distance, or a different distance, from center-to-center along the transverse direction T as the distance from center-to-center of adjacent electrical terminals 22 along the row direction. Accordingly, adjacent ones of the electrical terminals 22 along the transverse direction T, that is along a respective one of the columns 88, can be spaced a distance from center-to-center along the lateral direction A between approximately 1.2 mm and approximately 1.45 mm, such as between approximately 1.25 mm and approximately 1.45 mm, such as approximately 1.27 mm. Thus, the distance between adjacent ones of the rows 86 can be the same as or different than the distance between adjacent ones of the columns 88.

The electrical terminal 22 can each further include a housing retention assembly 60 disposed between the mating end 28 and the mounting end 42. The housing retention assembly 60 is configured to engage the connector housing 82 so as to ensure that the electrical terminal 22 is oriented properly, and retained in the connector housing 82. The housing retention assembly 60 can include a polarization wall 62 that extends out, for instance in the upward direction, from the base 25 of the body 24. The polarization wall 62 can be offset along the lateral direction A with respect to a lateral center of the electrical terminal 22. The connector housing 82 can define a groove 91 that is configured to receive the polarization wall 62 only when the electrical terminal 22 is inserted into the connector housing 82 only in a select orientation such that the contact beam 34 is spaced from the base 32 in the upward direction, and the receptacle 30 is open to a mating interface 81 of the connector housing 82. The polarization wall 62 will abut the connector housing 82 and prevent insertion of the electrical terminal 22 in the connector housing 82 if the electrical terminal is in another orientation other than the select orientation.

Figure 5D:
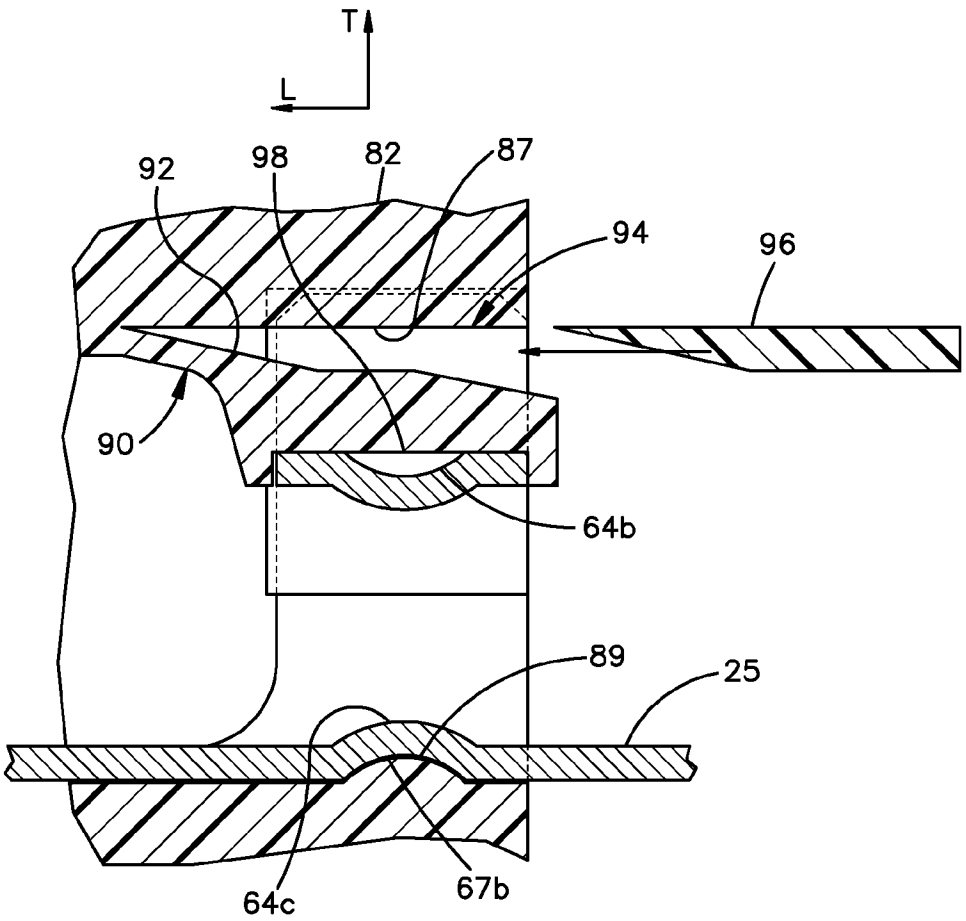
FIG. 5D is an alternate embodiment of the electrical connector illustrated in FIG. 5B.
Figure 5E:
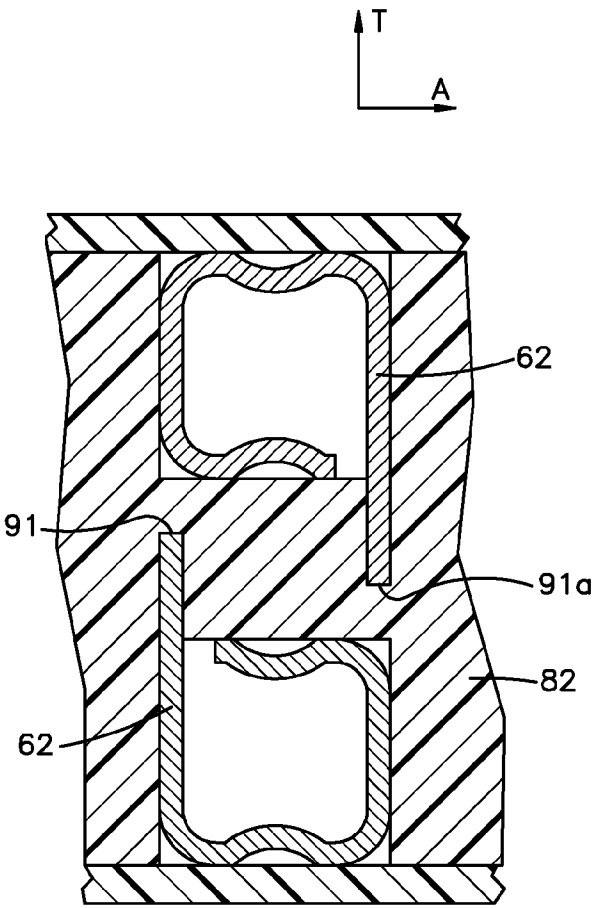
FIG. 5E is an alternate embodiment of the electrical connector illustrated in FIG. 5C.

Alternatively and preferably, as shown in FIG. 5E, the connector housing 82 defines a pair of grooves 91 and 91*a* oriented opposite to one another and which are each configured to receive the polarization wall 62 of separate electrical terminals 22. In each orientation, the electrical terminal 22 is inserted into the connector housing 82 only in a select orientation such that the contact beam 34 is spaced from the base 32 and the receptacle 30 is open to a mating interface of the connector housing 82. The formation of grooves 91 and 91*a* in this manner permit more efficient spacing of electrical terminals 22 within connector housing 82.

Referring again to FIGS. 5A-5C, the housing retention assembly 60 can further include a housing contact beam 64 that is configured to engage the connector housing 82 so as to assist in retention of the electrical terminal 22 in the connector housing 82. The housing contact beam 64 can include a base 64*c*, a side wall 64*a* that extends up from the base 64*c*, and an upper wall 64*b* that is cantilevered from the side wall along the lateral direction A. The base 25 of the body 24 can define the base 64*c* of the housing contact beam 64. It should be appreciated that the side wall 64*a* and the polarization wall 62 can be spaced from each other along the lateral direction A. In this regard, it should be appreciated that the side wall 64*a* and the polarization wall 62 can extend from opposite sides of the base 64*c*. The hosing contact beam 64 can include define at least one recess. For instance, the housing contact beam 64 can define a first recess 67*a* and a second recess 67*b*, which can each be configured as embossments. In one example, the first recess 67*a* can extend into the upper wall 64*b* in a downward direction opposite the upward direction. The second recess 67*b* can extend into the base 64*c* in the upward direction. Each of the first and second recesses 67*a* and 67*b* can be configured to receive and retain a complementary retention member 89 of the connector housing 82.

The retention member 89 can be configured as a protrusion carried by an inner surface of the connector housing 82, or by a latch 90 of the connector housing 82. For instance, the latch 90 can define a deflectable latch arm 92 that extends out from an inner surface 87 of the connector housing 82. The retention member 89 can extend out from a free end of the latch arm 92. Accordingly, as the electrical terminal 22 is inserted into the connector housing 82, the terminal body 24 can cause the latch arm 92 to deflect until the retention member 89 enters one of the recesses 67*a* and 67*b*. The latch arm 92 can provide a retention force to the retention member 89 against the body 24 in the respective one of the recesses 67*a* and 67*b*. It should be appreciated that the electrical connector 80 can define a gap 94 between the latch arm 92 and the surface 87 of the connector housing 82. The electrical connector 80 can further include a locking member 96, which can be configured as a shim that can be inserted into the gap 94 so as to abut the latch arm 92 and the surface 87 after the latch 90 has engaged the respective one of the recesses 67*a* and 67*b*. Thus, the locking member 96 is configured to retain the latch 90 in a latched position, whereby the latch retains the electrical terminal 22 in the connector housing. The locking member 96 can be removed, for instance if it is desired to remove the electrical terminal 22 from the connector housing 82. While the latch 90 is configured to engage the first recess 67*a*, it should be appreciated that the latch 90 can alternatively be configured to engage the second recess 67*b*. Alternatively still, the connector housing 82 can include first and second latches configured to engage respective ones of the first and second recesses 67*a* and 67*b*.

Alternatively and preferable, as shown in FIG. 5D, retention member 89, in housing retention assembly 60, defines a recess formed on either the inner surface of the connector housing 82 (FIG. 12) or on a latch 90*a* of the connector housing 82. For instance, the latch 90 can define a deflectable latch arm 92 that extends out from an inner surface 87 of the connector housing 82. A recess 98 is formed in the free end of the latch arm 92. Accordingly, as the electrical terminal 22 is inserted into the connector housing 82, the terminal body 24 can cause the latch arm 92 to deflect until the upper wall 64*b* enters recess 98. The latch arm 92 can provide a retention force to upper wall 64*b*. A gap 94 is formed between the latch arm 92 and the surface 87 of the connector housing 82. The electrical connector 80 can further include a locking member 96, which can be configured as a shim that can be inserted into the gap 94 so as to abut the latch arm 92 after the latch 90 has engaged upper wall 64*b*. Thus, the locking member 96 is configured to retain the latch 90 in a latched position, whereby the latch retains the electrical terminal 22 in the connector housing. The locking member 96 can be removed, for instance if it is desired to remove the electrical terminal 22 from the connector housing 82.

Figure 8:
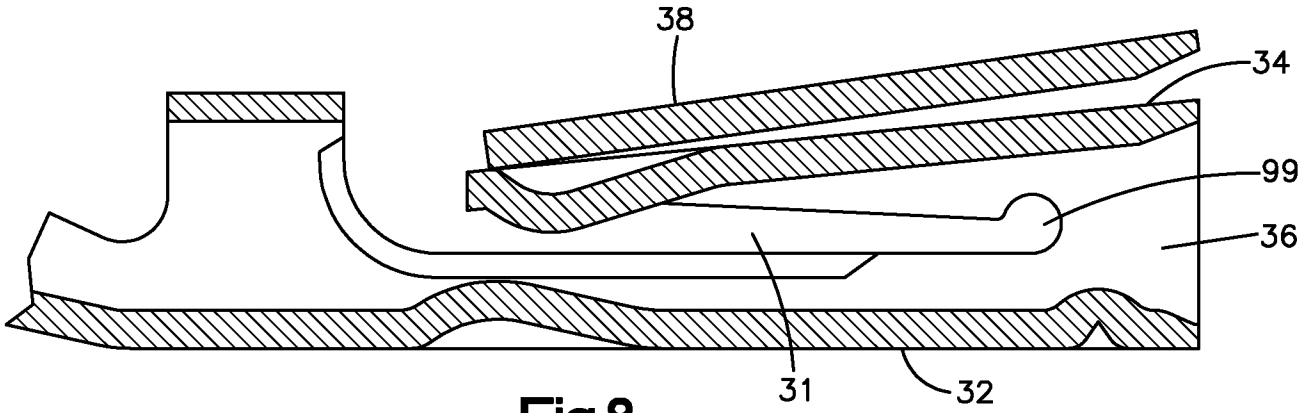
FIG. 8 is an alternate embodiment of the electrical terminal illustrated in FIG. 7.

Referring now to FIGS. 1A-2B, 6 and 7, it is again noted that side walls 36 and 40 define slot-like, triangular shaped openings 31 and 33 having an open end and a closed end. It may further be appreciated that the dimensioning of openings 31 and 33 will facilitate the deflection of contact beam 34, spring assist 38 and base 32. As shown in FIGS. 8 and 9, the closed end of slot 31 defines an enlarged opening 99. Opening 99 is preferably circular and having a diameter which is larger than the width of slot 31 immediately adjacent opening 99. The opening 99 functions to relieve stress occurring in side wall 36 when a pin is inserted between contact bumps 54*a* and 54*b*. It is preferred to provide a similar opening at the closed end of slot 33 in side wall 40.

Figure 10:
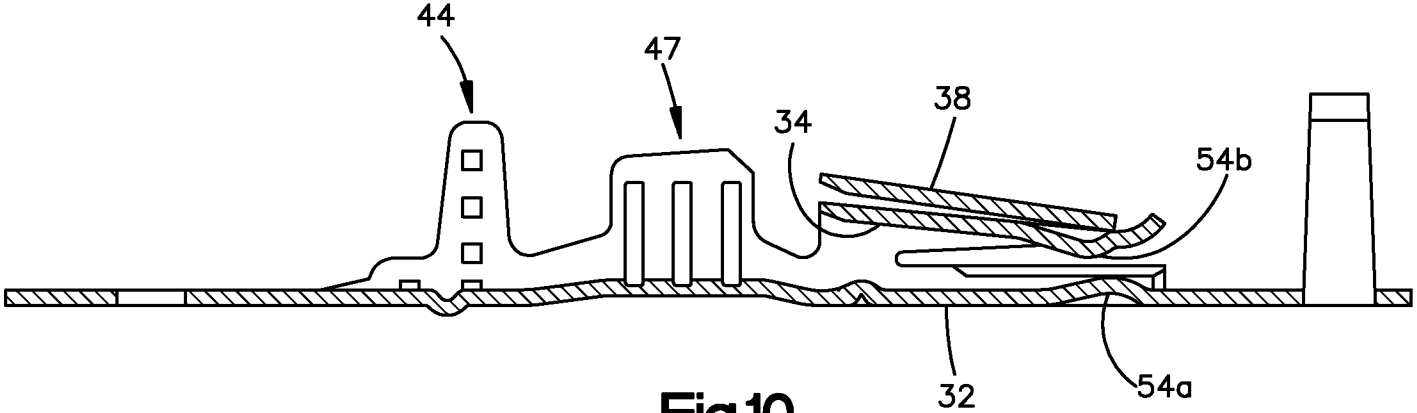
FIG. 10 is an alternate embodiment of the electrical terminal illustrated in FIG. 6.

While terminal 22 is depicted in the various figures as having a form and an orientation in which pins 35 are first inserted into the widest end of receptacle 30, the invention is not intended to be so limited. For example, receptacle 30 may be formed so that receptacle 30 has a reverse orientation as depicted in FIG. 10. In FIG. 10, receptacle 30 is oriented so that pins will be first inserted through the end containing contact bumps 54*a* and 54*b*.

It is noted that in the embodiments depicted in FIGS. 6-10, contact bump 56*b* is not depicted. Instead, the surface of contact beam 34 is smooth.

Figure 11:
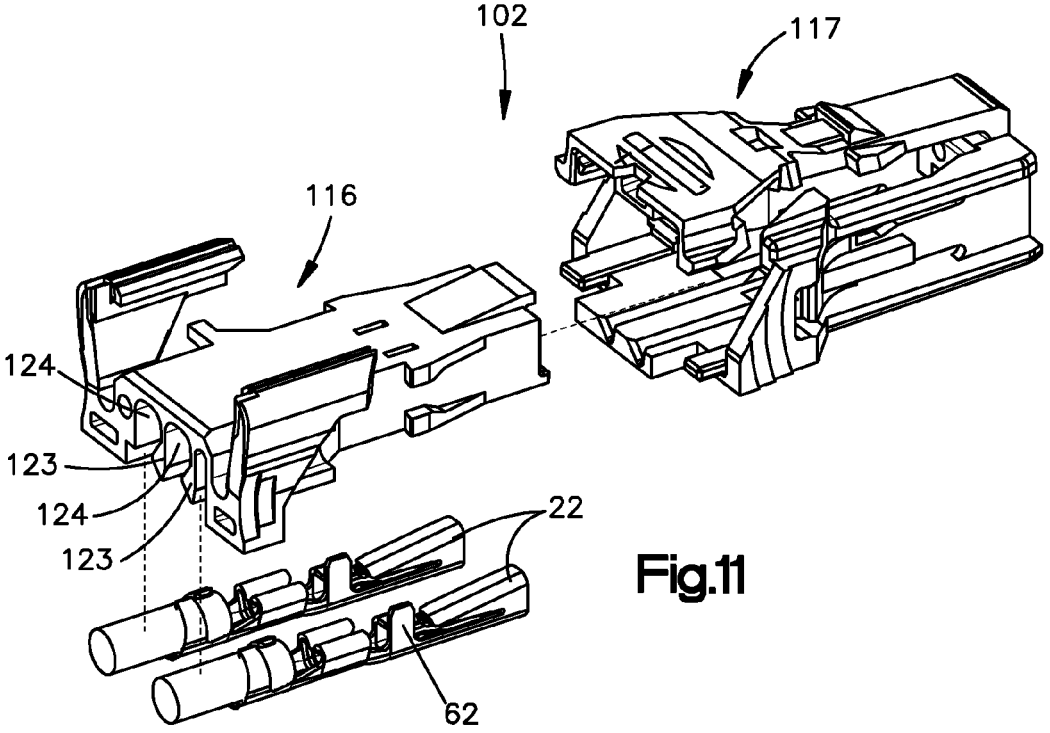
FIG. 11 is a perspective view of a cable connector constructed in accordance with an embodiment of the invention.
Figure 12:
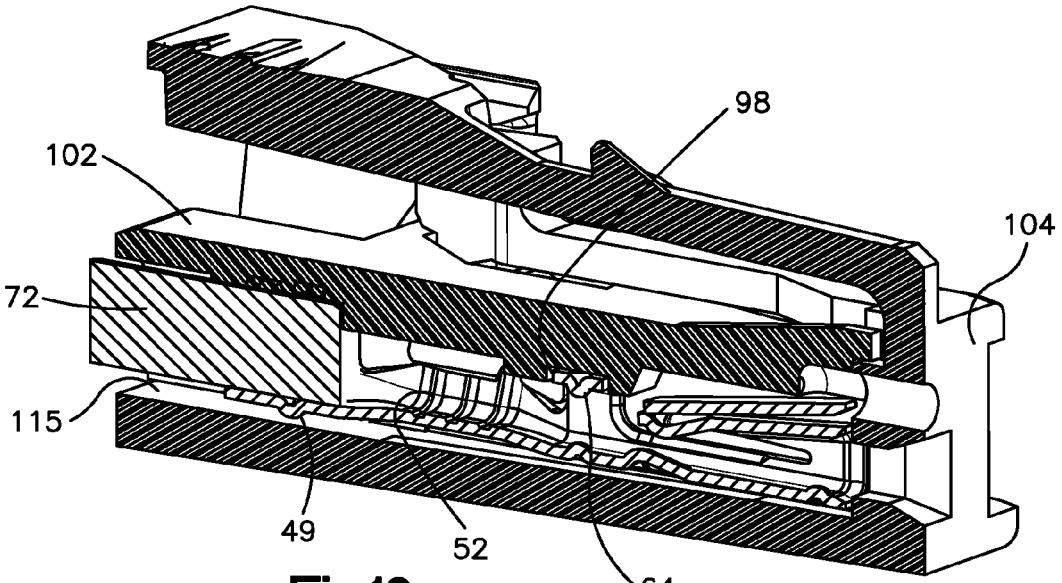
FIG. 12 is section view of the cable connector illustrated in FIG. 11.

Referring now to FIGS. 11 and 12, further advantages of electrical terminal 22 will be explained. As indicated above, it is preferred for contact bump 49 to extend away from insulative layer 72 to assist in the positioning of terminal 22 within the receptacle housing. In the preferred embodiment, receptacle housing 82 or cable connector 102 includes an inner core 116 and outer housing 117. Core 116 and outer housing 117 are designed for one to be inserted and locked within the other forming a cable connector 102. The cable connector, in turn, is preferably designed for insertion into a complementary designed pin header connector 103.

In the assembly of cable connector 102, terminals 22 are placed into appropriately sized recesses formed within the core. The interaction of polarization wall 62 with slots 124, similar to those depicted in FIGS. 5B and 5E, act as the initial alignment and retention mechanism for terminal 22. After insertion of terminals 22 onto inner core 116, the outer core 117 is mounted over the inner core 116. The outer housing is complementarily designed so that the outer housing slides over terminals 22 and acts to lock the terminals in place. Surfaces 115 formed within the outer housing 117 interact with base 32 and contact bump 49 to position and trap terminal 22 within a cavity formed by the core 116 and the outer housing 117. Also as mentioned above, it is preferred for contact bumps 52 to extend away from electrical conductor 74*a*. Similar to contact bump 49, contact bumps 52 interact surfaces within the slots 124 formed in the inner core 116 and help position terminal 22.

Figure 13:
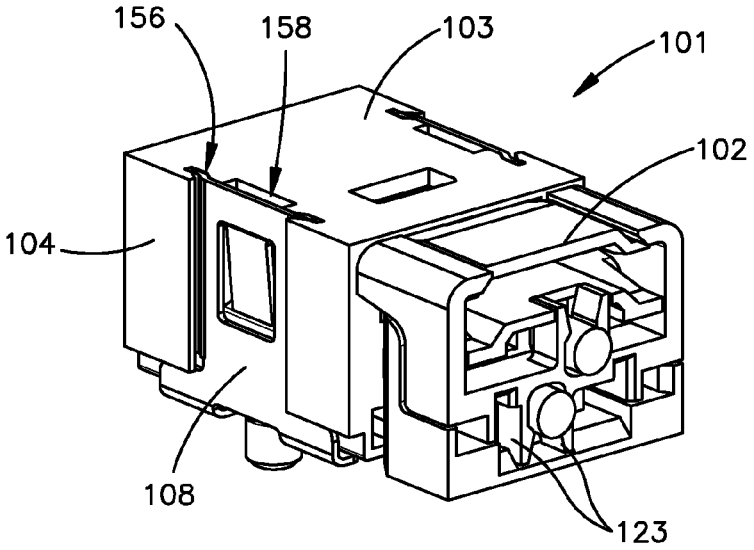
FIG. 13 shows an embodiment of an assembly of a pin header connector and a cable connector.
Figure 14:
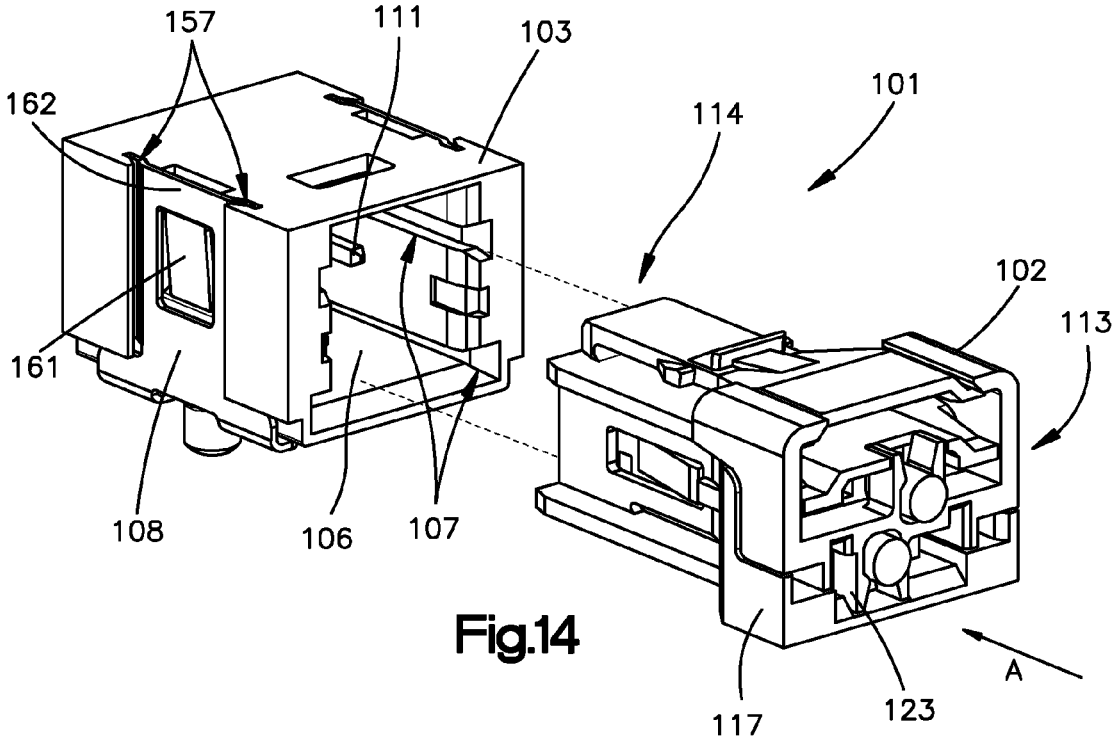
FIG. 14 shows the connectors of FIG. 13 apart.

Consider now the details of a desired cable connector assembly. FIG. 13 shows an assembly 101 of a cable connector 102 and a complementary pin header connector 103. The two connectors 102 and 103 are shown apart in FIG. 14.

The pin header connector 103 comprises a casing 104 with one open side exposing a receiving cavity 106 for receiving the cable connector 102. During assembly the cable connector 102 is moved into a connection direction A to be snapped into the receiving cavity of the pin header connector 103. Recesses 107 in the walls of the receiving cavity 106 extend in the connection direction A and are coded to allow insertion of the cable connector 102 only when it is correctly aligned.

Hold-downs 108 at opposite sides of the pin header connector 103 hold the casing 104 in place and connect it to a substrate, such as a printed circuit board. The casing 104 has a back side with openings 109 (see FIG. 15). Contact pins 110 are bent to have a first end 111 protruding into the receiving cavity 106 of the casing 104 in a direction parallel to the assembly direction A, and a second end 112 outside the casing 104 bent over about 180 degrees against the lower side of the casing 104 to make contact with circuitry on the substrate (not shown)

The cable connector 102 has a cable entry end 113 and a contact side 114 opposite to the cable entry end 113. The cable connector 102 comprises a core 116 clicked into an outer housing 117. The core 116 holds pin receiving terminal contacts 118 (also referred to as terminals 22) with one connected to cables 119, e.g. by means of a crimp connection, at the cable entry side 111 of the cable connector 102 (see FIG. 15). The opposite ends of the terminal contacts 118 comprise a pin receiving grip 119 for receiving the end 111 of a contact pin 110. The grips 119 are aligned with a pin respective receiving openings 121 in a wall of the housing 117 at the pin receiving side.

The housing 117 has an open side exposing a cavity 122 for receiving the core 116. The core 116 is inserted into the cavity 122 in an assembly direction B.

The core 116 includes two oppositely arranged clips 123 at the cable entry side. Both clips 123 hold a cable end 119 connected to the respective pin receiving terminal contact 118, e.g., with a crimp connection. The clips 123 are aligned with slots 124 in the core 116 receiving the terminal contacts 118 (see FIG. 20). The terminal contacts 118 and the slots 124 are shaped and dimensioned in such a way that the terminal contacts 118 can only be clipped into the slots 124 in a single position. The housing 117 comprises recesses 126 immobilizing and securing the clips 123 after insertion of the core 116 into the housing 117. The recesses are configured to allow insertion of the clips 123 in only one position of the core 116. The recesses 126 are dimensioned in such a way that they enclose and firmly tighten the clips 123 around the cable sheath.

Figure 17A:
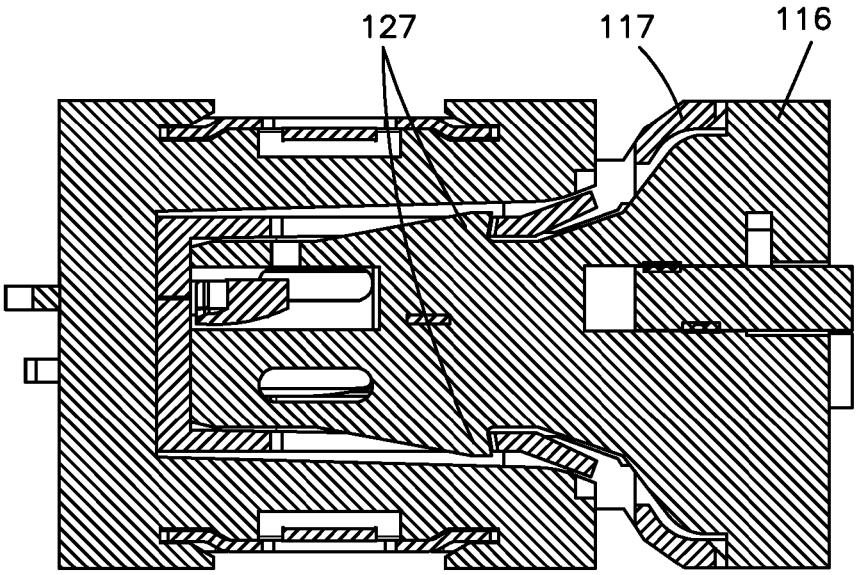
FIG. 17A shows an incorrectly assembled cable connector being blocked during mating.

FIGS. 17A and B show a cross section over the width of the connector assembly 101 of FIG. 13. Side faces of the core 116 comprise locking cams 127 sloping down into the assembly direction B. The housing 117 is provided with open side faces 128. As shown in FIG. 18A-C and FIG. 19, in both open side faces 128 a snap-action lever 129 extends from the pin receiving side of the housing 117 in the direction of the cable receiving side. The snap-action levers 129 comprise a central rectangular opening 131 for receiving the cams 127 of the core 116 in a latching manner. The terminal ends of the snap-action levers comprise a pair of protruding stops 132.

During insertion of the core 116 into the housing 117 the locking cams 127 of the core 116 pass the terminal end of the snap action lever 129. First the slanting surface of the cam 127 of the core slides over a correspondingly slanting face of the snap-action lever 129 at the inner side of the housing 117, while the cam 127 gradually pushes the snap-action lever 129 outwardly (see FIG. 17B and FIG. 19). After sliding over a straight surface, the cam 127 snaps into the central rectangular opening 131 of the snap-action lever 129 and the core 116 is locked within the housing 117 in such a way that the contact terminals 118 (also referenced as 22) are in line with pin receiving openings 121 in the housing 117. This way the snap-action levers 129 constitute a so-called terminal positioning assurance (TPA) mechanism.

Figure 17B:
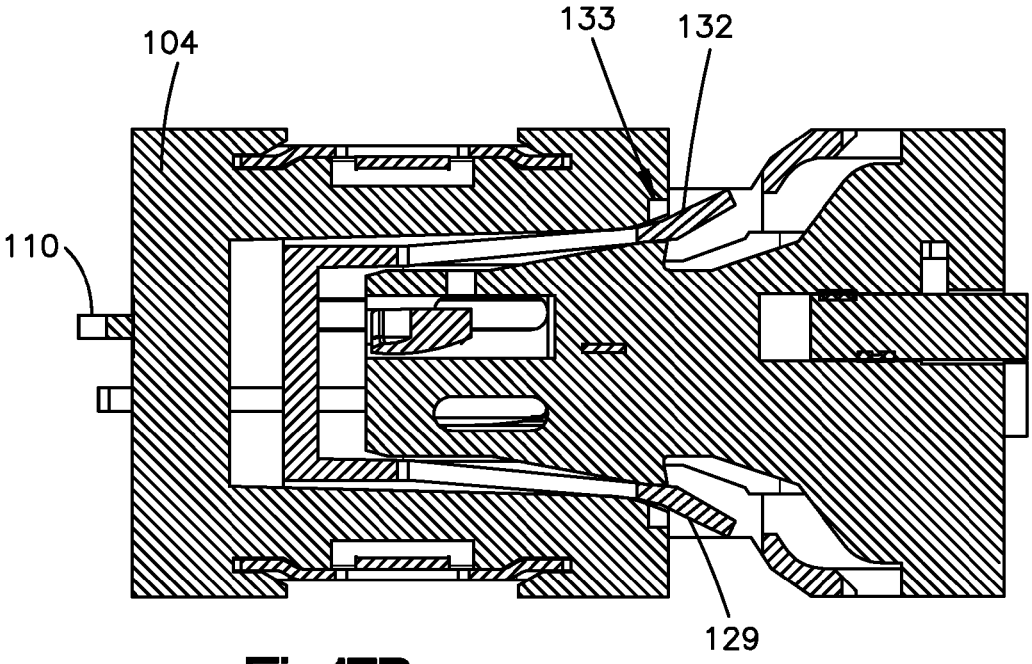
FIG. 17B shows the cable connector during mating when assembled correctly.

The positioning and dimensioning of the rectangular openings 131 of the levers 129 of the housing 117 allows the core 116 to snap into the housing in only one single correct position. If the core 116 would be inserted incorrectly, none or at most only one of the cams 127 could snap into the respective opening 131. The cams 127 that do not snap would flex the respective snap-action lever 129 with the protruding stop 132 outwardly. During assembly the outwardly flexed stops 132 would be stopped by a counter stop 133 of the counter connector 103, as shown in FIG. 17B. As a result, the assembly of the core 116 and the housing 117 is blocked from insertion into the receiving cavity of the pin header connector 103. This way it is guaranteed that only correctly assembled cable connectors 102, having their terminal contacts 111 properly aligned with the pin receiving openings 121 can be locked by a pin header connector 103.

Figure 21:
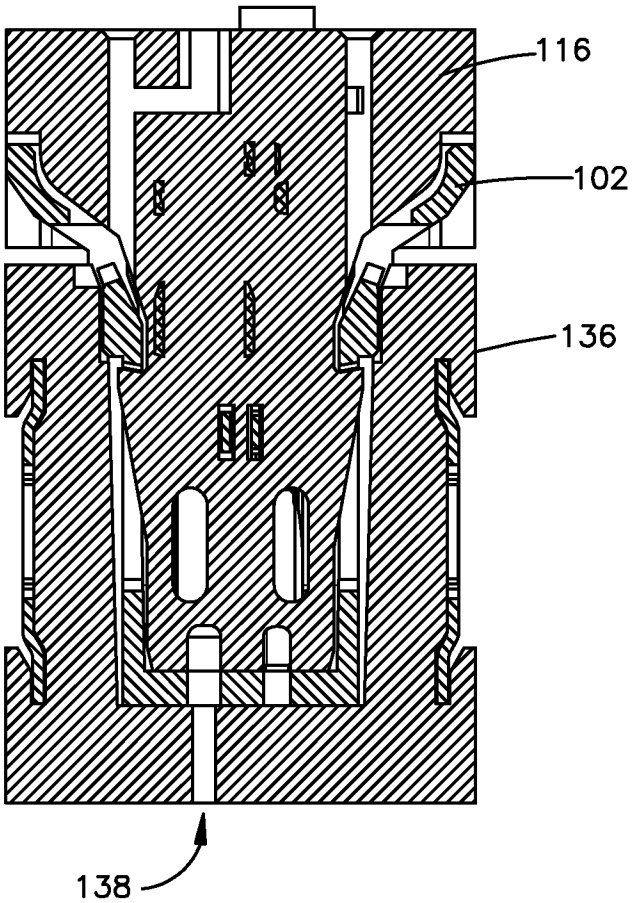
FIG. 21 shows a cross section over the width of the cable connector of FIG. 13 positioned in a test gauge.

Alternatively, a gauge 136 can be used to test the assembly of the cable connector (FIG. 21). The gauge 136 may have a receiving cavity identical to the receiving cavity of a complementary pin header connector. An incorrectly assembled connector 102 cannot be fully inserted into the gauge 136, while a correctly assembled connector exactly fits within the receiving cavity of the gauge 136. If the cable connector 102 is not properly assembled, although the core 116 is properly oriented, a continued mating force may force the core 116 further into the receiving cavity 122 of the housing 117 and correct the misassembly. If the core 116 reaches its final position the cams 127 will still snap into the respective recesses 131 and the cable connector 102 can still be pushed further into the gauge 136 to reach its correct position.

Figure 22:
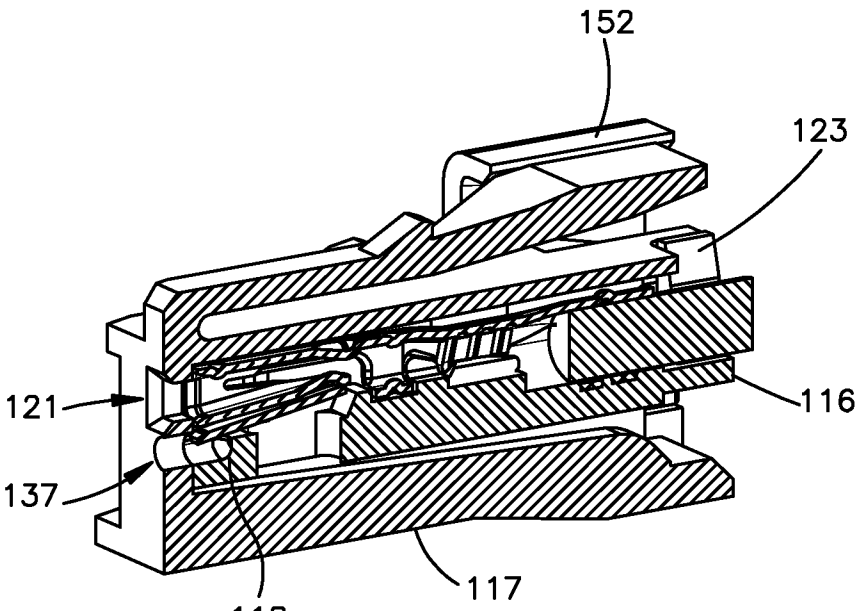
FIG. 22 shows a longitudinal cross section of the cable connector of FIG. 13.

FIG. 22 shows a longitudinal cross section of the cable connector 102 in perspective view. Just below the pin receiving opening 121 is a smaller second opening 137 just below the contact terminal 118. The gauge 136 is provided with a channel 138 in line with the opening 137 in the cable connector 102 (FIG. 21). When the cable connector 102 is received in the gauge 136 a spring-loaded test pin (not shown) can be inserted via the channel 138 into this second opening. If the contact terminal 118 would be misaligned with the pin receiving opening 121, it would hinder passage of the test pin through the second opening 137. This allows easy testing of the position of the terminal contact 118 without the need to use a test pin in the pin receiving terminal 118 itself, which could damage the terminal contact 118 or remove a usually applied golden microlayer from the terminal contact 118. The spring-loaded test pin inserted into the smaller opening 137 can be circuited with the cable end 119 to test the crimp connection. Similarly the spring-loaded test pin can also be used to test the isolation between the various parts of the circuit by means of a hipot test.

Figure 23:
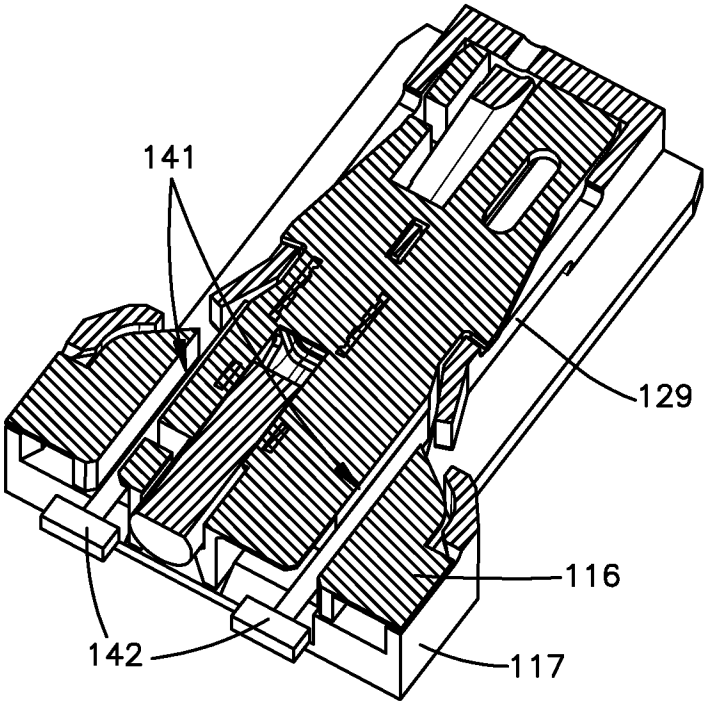
FIG. 23 shows a cross section over the width of the cable connector of FIG. 13 with inserted release pins.

The cams 127 of the core 116 and the latches of the snap-action levers 129 of the housing form a non-releasable snap joint. Intentional disassembly is however made possible by two parallel channels 141 (see FIG. 23), each leading from the cable entry side of the connector 102 through the core 116 towards the slanting surfaces of the snapped latches 129. A release pin 142 can be inserted into the channel 141. Pushing the inserted tip of the pin 142 against the slanting surface of the latch 129 will push the latch aside allowing the housing 117 to be removed from the core 116.

Figure 15:
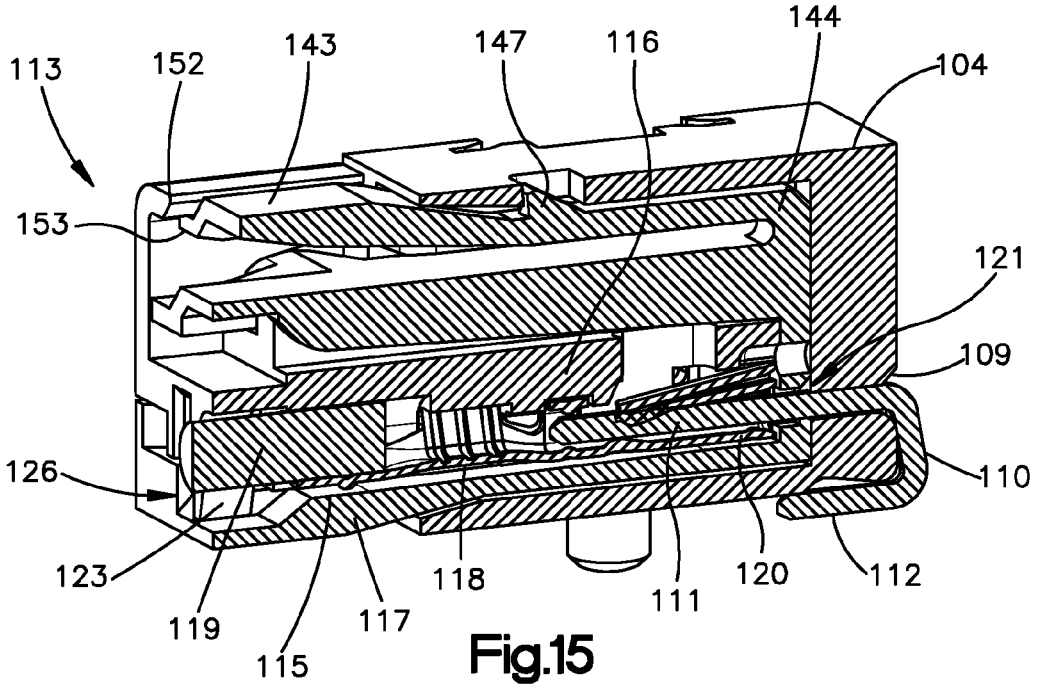
FIG. 15 shows the assembly of FIG. 13 in cross section.
Figure 16:
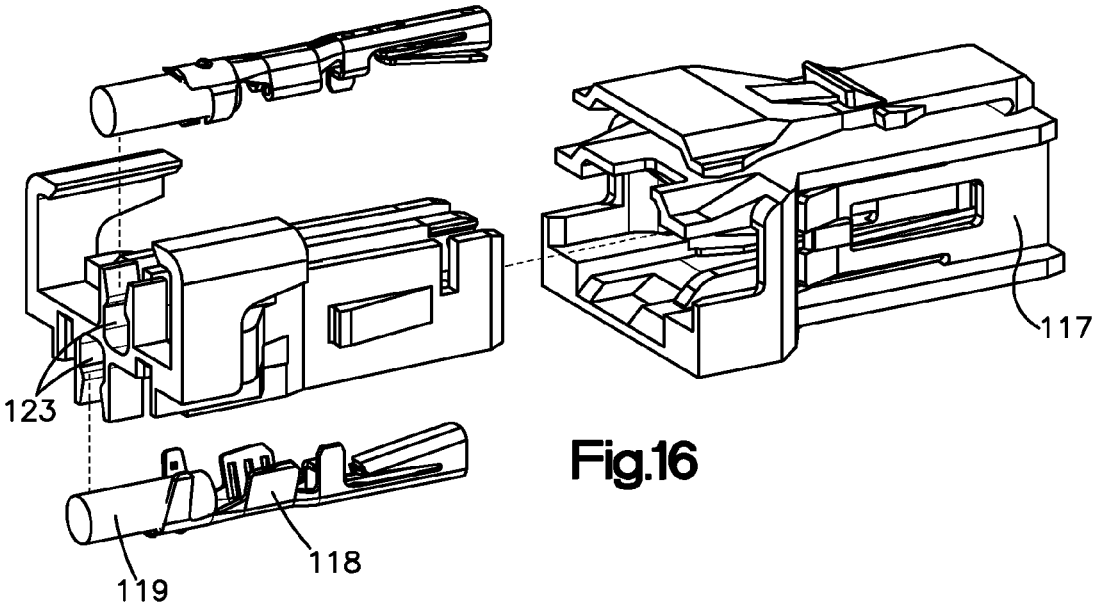
FIG. 16 shows the cable connector of FIG. 13 in exploded view.
Figure 18A:
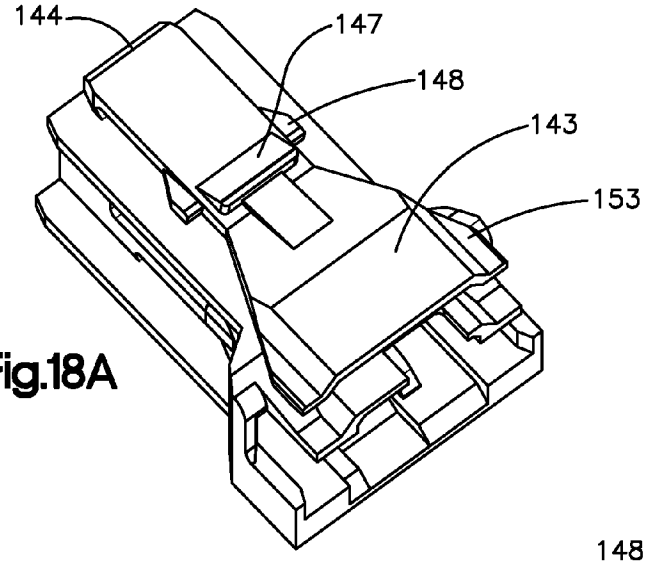
FIG. 18A-C shows three different views of a housing of the cable connector of FIG. 13.
Figure 18C:
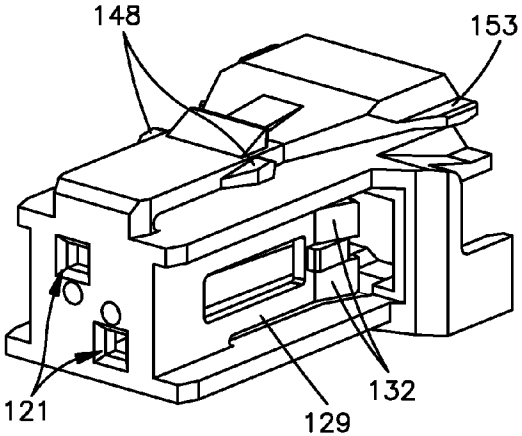
Figure 18B:
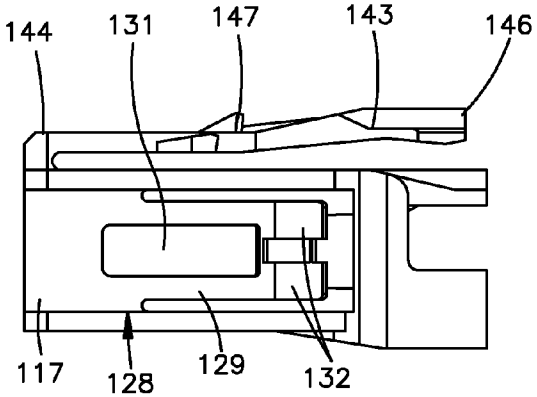
Figure 19:
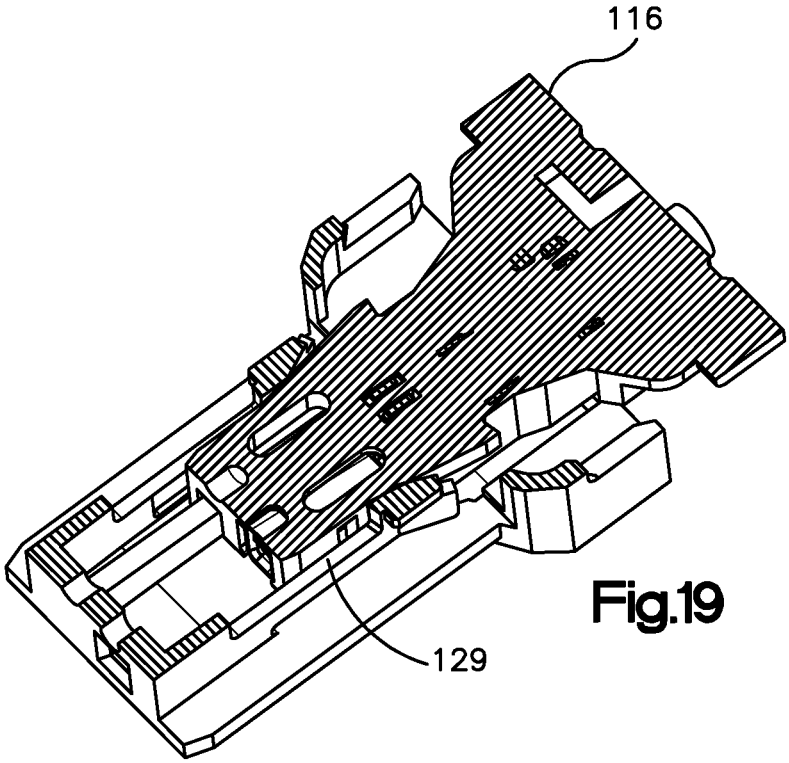
FIG. 19 shows in cross section the cable connector of FIG. 13 during assembling.

As is particularly shown in FIGS. 15 and 18B, an upper face of the housing 117 of the cable connector 102 is provided with a top side latch 143 with one end 144 hingeably connected to the rest of the housing 117 at the pin receiving side of the housing, and a free opposite end 146 pointing towards the cable entry side. An upper surface of the top side latch carries a cam 147 at a distance from the hinging connection 144. Optionally, the cam 147 can be split by one or more slots to form a row of two or more separate cams. At both sides of the cam 147, the top side latch 143 comprises oppositely arranged sidewardly extending side cams 148. All cams 147, 148 slant down towards the pin receiving side and have a blunt side facing the cable entry side to provide a non-releasing snap joint with engaging snap faces of the pin header connector. The combination of spaced cams 147, 148 pointing in different directions increases the retention force, required to force disconnecting the cable connector 102 from the pin header connector 103 and further secure the connection by providing redundancy. The cams 147, 148 are dimensioned and configured to provide a retention force, which is substantially less than the force required for removing the core 116 from the house 117. This avoids the risk that attempted forced disconnection of the two connectors 102, 103 could tear the core 116 and the housing 117 of the cable connector 102 apart, thereby exposing potentially powered contacts.

Figure 20:
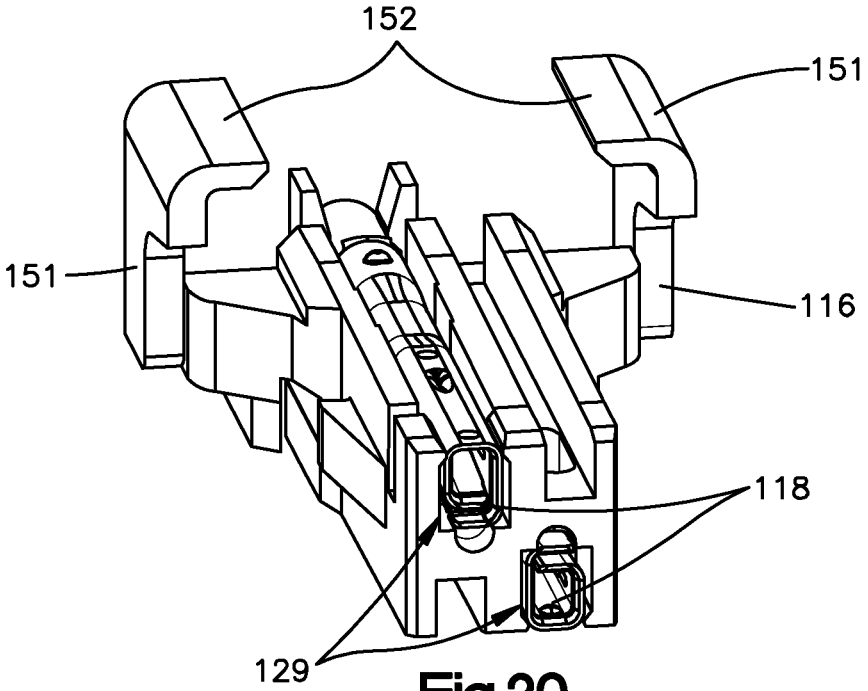
FIG. 20 shows a core of the cable connector of FIG. 13.

As shown in FIG. 20 the core 116 is provided with two opposite side flanges 151 at the cable entry side. The side flanges 151 extend upwardly and have upper edges 152 curved to point toward each other. At its root at the cable entry side the top side latch 143 (see FIGS. 18A-C) has two side ridges 153 extending below the curved edges 152 of the core's side flanges 151 in the assembled condition of the cable connector 102 (see also FIG. 15). The side flanges 151 protect the top side latch 143, for example from unintentional actuation, e.g., by crossing cables. The curved edges 152 of the side flanges 151 can also be used to pre-load the top side latch 143 to increase the snapping force. They also prevent that a user might bent the top latch upwardly and break off the latch 143 at the position of the hinge section 144.

Figure 24:
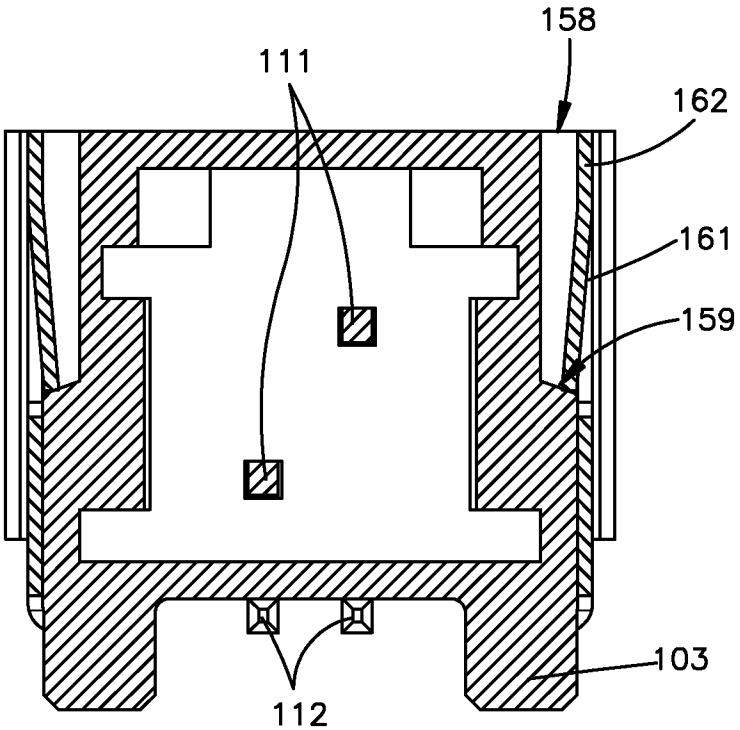
FIG. 24 shows in cross section a casing with hold-downs of the pin header connector of FIG. 13.

FIG. 24 shows the pin header connector 103 with the hold-downs 108 in cross section. The pin header connector 103 has two opposite side faces provided with recesses 156 running from the top face of the pin header connector 103 to its bottom face. The side walls of the recesses 156 are provided with slits 157 receiving edges of the hold downs (see FIG. 14). The recesses in the side walls of the connector are provided with a further recess 158 extending from the top face of the connector to a bottom 159 at a distance from the lower side of the pin header connector 103. The hold-downs 108 are provided with a resilient web 161 extending downwardly from an upper part 162 of the hold-down. The webs 161 are bent inwardly, e.g., over a small angle or they may be offset inwardly via an inwardly bent strip. The connector can be positioned between the hold-downs 108 by pushing the edges of the hold-downs 108 into the respective slits 157 at the sides of the recesses 156. The casing of the pin header connector 103 will flex the resilient webs 156 inwardly. Just when the pin header connector 103 is in its final position, the webs 161 snap into the respective second recess 158, as is shown in FIG. 24. The bottom 159 of the second recess 158 slightly slants to guarantee that the tip of the resilient web 161 will firmly engage the bottom 159 of the recess 158 in order to suppress any clearance.

Figure 25:
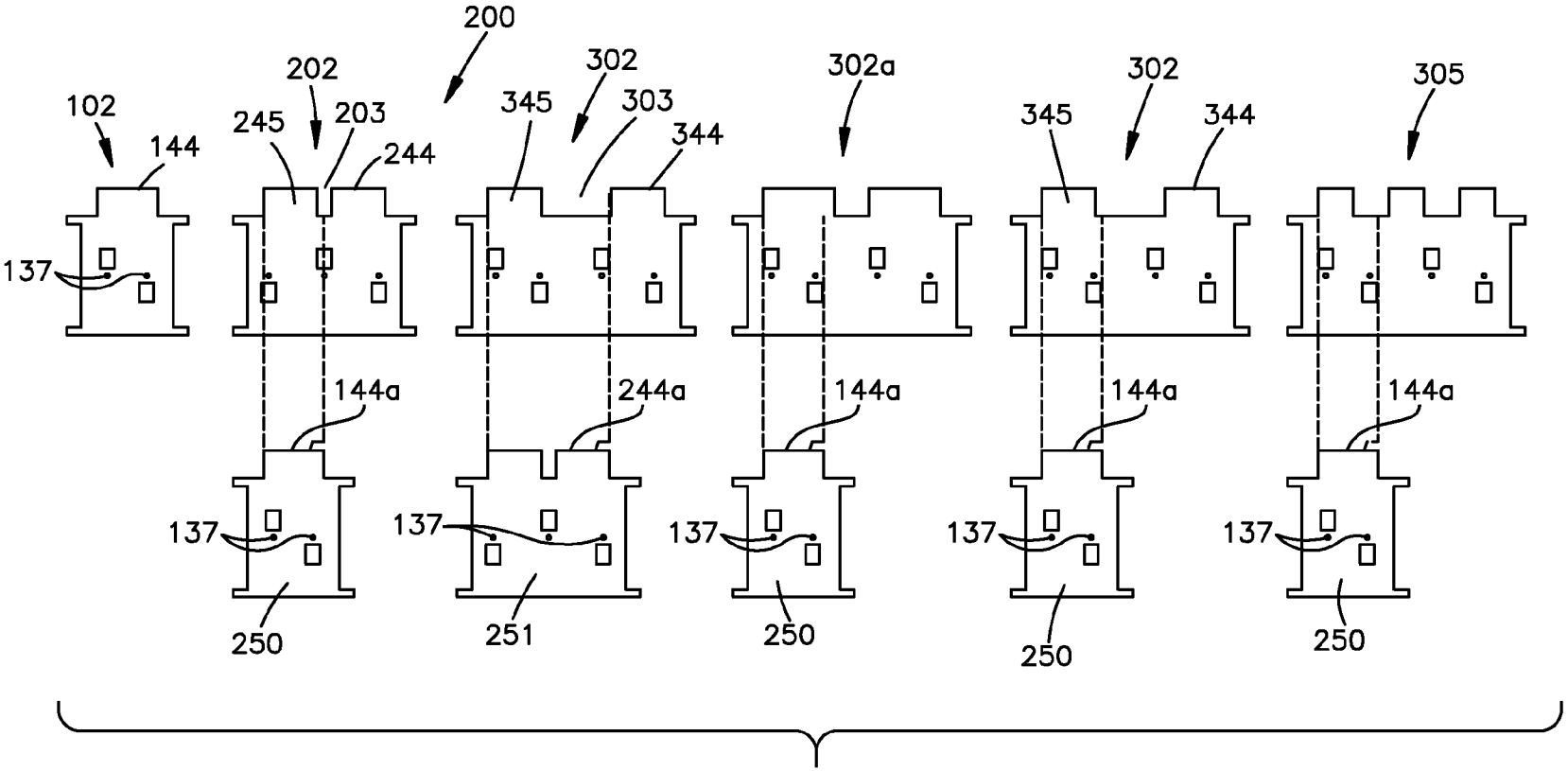
FIG. 25 shows a set of cable connectors with different numbers of contacts.

FIG. 25 shows a set 200 of cable connectors with different numbers of contacts. The connectors are shown in front view. Besides the cable connector 102 the set includes two or more other cable connectors 202, 302 of a similar type but presenting a different number of contacts. The outline of the cable connectors 102, 202, 302 are profiled to provide a polarization feature, such that the cable connectors fit into the receiving cavity of the pin header connector in only one position. A main feature of this polarization profile is the hinge 144, 244, 344 forming an upward protruding extension in the shown front view. The respective receiving pin header connectors 250 and 251 are provided with a complementary slot 144A receiving the hinge section 144, 244, 344. In the set shown in FIG. 25, the width of the total hinge 144, 244, 344 increases with the number of contacts. However, the width of the individual extensions 144, 245, 345 decreases with the number of contacts. The cable connectors 202, 302 with more than two contacts have a hinge section 244, 344 with a central slot 203, 303 having a total width increasing with the number of contacts. The slot splits the hinge section 244, 344 in two hinge parts 245, 345 with a width which is less than the total width of the hinge section 144, 244 of a connector with less contacts.

The respective receiving pin header connectors are provided with a rib matching with the slot of the corresponding cable connector. This prevents that cable connectors with less contacts could be inserted into a pin header connector with more contacts.

As shown in FIG. 25, the width of the hinge 144 of the two-contact cable connector 102 is too large to allow connection to a pin header connector matching a cable connector 202, 302 with more than two contacts.

FIG. 25 also shows a connector 302A with four contacts with hinge parts broader than the hinge 144 of the two-contact cable connector 102. In such a case the smaller cable connector 102 could be inserted into a pin header connector that should be used with larger cable connectors 302A. This situation creates a risk and should be avoided.

Connector 305 has two slots 306, resulting in three hinge parts of a width sufficiently small to enable the complementary pin headers to block insertion of a smaller cable connector 102, 202.

The foregoing description is provided for the purpose of explanation and is not to be construed as limiting the invention. While various embodiments have been described with reference to preferred embodiments or preferred methods, it is understood that the words which have been used herein are words of description and illustration, rather than words of limitation. Furthermore, although the embodiments have been described herein with reference to particular structure, methods, and embodiments, the invention is not intended to be limited to the particulars disclosed herein. For instance, it should be appreciated that structure and methods described in association with one embodiment are equally applicable to all other embodiments described herein unless otherwise indicated. Those skilled in the relevant art, having the benefit of the teachings of this specification, may effect numerous modifications to the invention as described herein, and changes may be made without departing from the spirit and scope of the invention, for instance as set forth by the appended claims.

What is claimed:

1. An electrical terminal comprising:

an electrically conductive monolithic body including a mating end that includes a base, a contact beam, and a spring assist member collectively defining an opening at the mating end for receiving a complementary plug terminal, wherein said contact beam and said spring assist member are spaced from said base and are fixed at one end relative to said base, terminating in a free end, and wherein said contact beam and said spring assist member overlap from the mating end towards the free end, and wherein said monolithic body comprises a first opening between said base and said contact beam, the opening being configured to create a pivotal mounting of the contact beam and the spring assist member with respect to the base at the mating end, wherein said contact beam presses against the spring assist member as the contact beam is deflected from an initial position to a deflected position, and wherein said contact force increases when the contact beam and the spring assist member pivot with respect to the base.

2. The electrical terminal as recited in claim 1, wherein:

the monolithic body comprises a first side wall that extends from the base to the contact beam and a second side wall parallel to the first side wall that extends from said base to said spring assist member; and said first opening is in the first side wall; and the monolithic body comprises a second opening in the second side wall.

3. The electrical terminal as recited in claim 2, wherein the contact beam abuts the spring assist member along at least one end.

4. The electrical terminal as recited in claim 2, wherein the contact beam abutting the spring assist, together with the shape of the first and second openings, is configured to provide an elastic contact force of at least 3 Newtons.

5. The electrical terminal as recited in claim 2, wherein the side walls each comprise slot-like, triangular openings that extend along a portion of the length of said contact beam and said spring assist.

6. The electrical terminal as recited in claim 1, wherein the spring assist member is configured to provide a brace for the contact beam after the contact beam has reached a deflected position.

7. The electrical terminal as recited in claim 1, wherein the spring assist member comprises a spring assist wall that is oriented substantially parallel to the contact beam.

8. The electrical terminal as recited in claim 1, wherein the spring assist member is spaced from one end of the contact beam by a gap adjacent the opening at the mating end.

9. The electrical terminal as recited in claim 1, wherein said contact beam and spring assist are angled toward the base at different angles.

10. An electrical terminal comprising:

an electrically conductive monolithic body including a mating end that includes a base, a contact beam, and a spring assist member collectively defining an opening at the mating end for receiving a complementary plug terminal, wherein said contact beam and said spring assist member are spaced from said base and are fixed at one end relative to said base, terminating in a free end, and wherein said contact beam and said spring assist member overlap from the mating end towards the free end, wherein said monolithic body comprises a first opening and a second opening between said base and said contact beam, the first and second openings being configured to create a pivotal mounting of the contact beam with respect to the base at the mating end, wherein said contact beam presses against the spring assist member as the contact beam is deflected from an initial position to a deflected position, and wherein said contact force increases when the contact beam presses against the spring assist member, and wherein said first and second openings are triangular.

11. The electrical terminal as recited in claim 10, wherein:

said first and second openings are configured so that said contact beam is deflectable from a first position to a second position; and the deflection of said contact beam is at least partially rotational from said first position to said second position.

12. The electrical terminal as recited in claim 11, wherein said contact beam is oriented at an angle relative to said base.

13. The electrical terminal as recited in claim 11, wherein said spring assist member is oriented at an angle relative to said contact beam.

14. The electrical terminal as recited in claim 13, wherein the open end is configured to receive a complementary electrical terminal and wherein receipt of said terminal urges the contact beam from the initial position to the deflected position at least in part by pivoting about the pivotal mounting to the base.

15. An electrical terminal comprising:

an electrically conductive monolithic body including a mating end that includes a base, a contact beam, and a spring assist member collectively defining an opening at the mating end for receiving a complementary plug terminal, wherein said contact beam and said spring assist member are spaced from said base and are fixed at one end relative to said base, terminating in a free end, and wherein said contact beam and said spring assist member overlap from the mating end towards the free end, wherein said monolithic body comprises a a pivotal mounting of the contact beam with respect to the base at the mating end, wherein said contact beam presses against the spring assist member as the contact beam is deflected from an initial position to a deflected position, wherein said contact force increases when the contact beam presses against the spring assist member, and wherein the monolithic body comprises a first side wall that extends from the base to the contact beam and a second side wall parallel to the first side wall that extends from said base to said spring assist member; and wherein the first and second side walls each have a varying respective height from the base along a transverse direction, resulting in an angled orientation of the contact beam and the spring assist member with respect to the base.

16. An electrical terminal comprising:

an electrically conductive monolithic body including a mating end that includes a base, a contact beam, and a spring assist member collectively defining an opening at the mating end for receiving a complementary plug terminal, a first contact bump that projects from the base toward the contact beam, and a second contact bump that projects from the contact beam toward the base, wherein the first and second contact bumps define respective first and second contact locations for contacting an electrical terminal received in the receptacle, wherein said contact beam and said spring assist member are spaced from said base and are fixed at one end relative to said base, terminating in a free end, wherein said monolithic body comprises a first opening between said base and said contact beam, the opening being configured to create a pivotal mounting of the contact beam and the spring assist member with respect to the base at the mating end, wherein said contact beam presses against the spring assist member as the contact beam is deflected from an initial position to a deflected position, and wherein said contact force increases when the contact beam and the spring assist member pivot with respect to the base.

17. The electrical terminal as recited in claim 16, further comprising a third contact bump that extends from the base toward the contact beam and a fourth contact bump that extends from the contact beam toward the base.

18. The electrical terminal as recited in claim 16, wherein the first and second contact bumps are positioned offset from one another.

19. An electrical connector comprising:

an electrically insulative connector housing; and a plurality of electrical terminals supported by the connector housing, each of the electrical terminals including a body including a mating end that includes a base, a first side wall, a second side wall, a contact beam and a spring assist member collectively defining an opening at the mating end for receiving a complementary plug terminal; and a gap between the spring assist member and the contact beam at the mating end, wherein said contact beam and said spring assist member are spaced from said base and are fixed relative to said base at one end and terminate in a free end, wherein said contact beam and said spring assist member substantially overlap, wherein the spring assist member has an elongated axial direction and has free edges extending generally in the axial direction, and wherein said body comprises a slot-like first opening in the first sidewall between said base and said contact beam, the first opening extending to an edge of the first side wall away from the mating end.

20. The electrical connector as recited in claim 19, wherein each of the electrical terminals further includes a mounting end opposite the mating end, the mounting end including a first crimp tab configured to retain an outer insulative layer of an electrical cable, and a contact member configured to be placed in electrical communication with an electrical conductor of the electrical cable that is surrounded by the outer insulative layer.

21. The electrical connector as recited in claim 19, wherein the electrical terminals are arranged in an array that includes a plurality of rows that extend along the lateral direction and columns that extend in a transverse direction includes the upward direction.

22. An electrical connector comprising:

an electrically insulative connector housing; and a plurality of electrical terminals supported by the connector housing, wherein:

the plurality of terminals are arranged in an array that that extends along a lateral direction, and each of the electrical terminals comprises a body including a mating end that includes a base, a contact beam and a spring assist member collectively defining an opening at the mating end for receiving a complementary plug terminal, a mating end of the spring assist member is not fixed to the contact beam, said contact beam and said spring assist member are spaced from said base and are pivotally attached to said base at the mating end and terminate in a free end, wherein in pivotal attachment is provided by slot-like openings in sidewalls of the body attaching the contact beam and said spring assist member to the base, and said contact beam and said spring assist member at least partially overlap, such that said contact beam and said spring assist member together generate a contact force when said plug terminal is inserted, and said body comprises a first opening between said base and said contact beam, and adjacent ones of the electrical terminals are spaced a distance from center-to-center along the lateral direction between approximately 1.25 mm and approximately 1.5 mm.

* * * * *